US007357491B2

(12) United States Patent
Kojima

(10) Patent No.: US 7,357,491 B2
(45) Date of Patent: Apr. 15, 2008

(54) LIQUID EJECTION HEAD AND METHOD OF MANUFACTURING LIQUID EJECTION HEAD

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 144 days.

(21) Appl. No.: 11/374,083

(22) Filed: Mar. 14, 2006

(65) Prior Publication Data

US 2006/0209141 A1 Sep. 21, 2006

(30) Foreign Application Priority Data

Mar. 15, 2005 (JP) ..... 2005-073408

(51) Int. Cl.
*B41J 2/045* (2006.01)

(52) U.S. Cl. ..... 347/68; 347/69

(58) Field of Classification Search ..... 347/67, 347/68, 69, 70, 71

See application file for complete search history.

(56) References Cited

U.S. PATENT DOCUMENTS

| | | | | |
|---|---|---|---|---|
| 5,754,205 | A * | 5/1998 | Miyata et al. | 347/70 |
| 5,912,684 | A * | 6/1999 | Fujii et al. | 347/54 |
| 6,109,736 | A | 8/2000 | Miyata et al. | |
| 6,616,270 | B1 | 9/2003 | Miyata et al. | |

FOREIGN PATENT DOCUMENTS

| | | | |
|---|---|---|---|
| JP | 9-314833 | A | 12/1997 |
| JP | 10-305578 | A | 11/1998 |
| JP | 2000-127379 | A | 5/2000 |
| JP | 2003-127366 | A | 5/2003 |

* cited by examiner

*Primary Examiner*—Lamson Nguyen
(74) *Attorney, Agent, or Firm*—Birch, Stewart, Kolasch & Birch, LLP

(57) ABSTRACT

The liquid ejection head comprises: a plurality of pressure chambers which contain liquid and are arranged in a two-dimensional matrix configuration; a plurality of nozzles which connect to the pressure chambers and eject the liquid; a diaphragm which forms one face of the pressure chambers; a plurality of piezoelectric elements which are formed on a face of the diaphragm reverse to a face thereof adjacent to the pressure chambers, each of the piezoelectric elements corresponding to each of the pressure chambers; a plurality of electrical wires which connect to the piezoelectric elements and extend in a direction substantially perpendicular to the face on which the piezoelectric elements are formed; a sealing member which seals off at least one of the piezoelectric elements and at least one of the electrical wires so that space is formed over a side of the at least one of the piezoelectric elements reverse to a side adjacent to the diaphragm; and a common liquid chamber which supplies the liquid to the pressure chambers and is arranged on a side of the sealing member reverse to a side thereof on which the pressure chambers are arranged.

6 Claims, 21 Drawing Sheets

LIQUID EJECTION HEAD AND METHOD OF MANUFACTURING LIQUID EJECTION HEAD

BACKGROUND OF THE INVENTION

1. Field of the Invention

The present invention relates to a liquid ejection head and a method of manufacturing a liquid ejection head, and more particularly, to technology for achieving high-density arrangement of electrical wires which supply drive signals to actuators that cause liquid to be ejected from ejection ports of a liquid ejection head.

2. Description of the Related Art

As an image forming apparatus, an inkjet printer (inkjet recording apparatus) is known, which comprises an inkjet head (liquid ejection head) having an arrangement of a plurality of nozzles (ejection ports) for ejecting ink (liquid). The inkjet printer can form an image on a recording medium by ejecting ink from the nozzles toward the recording medium while the inkjet head and the recording medium are caused to be relatively moved to each other.

For example, as an ink ejection method used in such an inkjet recording apparatus, a piezoelectric method is known, in which a diaphragm which forms one face of a pressure chamber (ink chamber) is deformed by deforming a piezoelectric element, and thereby the volume of the pressure chamber is changed. Ink is introduced into the pressure chamber through an ink supply passage when the volume of the pressure chamber is increased, and the ink inside the pressure chamber is ejected from the nozzle in the form of an ink droplet when the volume of the pressure chamber is decreased.

Furthermore, in recent years, it has been sought to form high-quality images similar to photographic prints, with such inkjet recording apparatuses. For this purpose, it is required to reduce the size of the ink droplets ejected from the nozzles by reducing the size of the nozzles much further, and to arrange the nozzles at higher density.

This requires the pressure chambers which are connected to the nozzles to be disposed in a high-density arrangement, in conjunction with the increased density of the nozzles. Furthermore, the electrical wires which supply drive signals to the piezoelectric elements disposed corresponding to the pressure chambers, are also required to be arranged at higher density.

In order to achieve higher density arrangement of the nozzles in this manner, various proposals have been made.

For example, Japanese Patent Application Publication No. 9-314833 discloses an inkjet print head. It is an object of such an inkjet print head to avoid operational errors in the driving of the inkjet print head having high nozzle density, and to reduce the costs of manufacturing the head. In the inkjet print head, pressure chambers are arranged in a horizontal direction with respect to the print surface; piezoelectric elements are arranged on a diaphragm that forms the upper surface of the pressure chambers; a reservoir (common liquid chamber) for supplying ink to the pressure chambers is arranged above the diaphragm; and wires from the piezoelectric elements are extended horizontally and connected to TFTs (thin film transistors) arranged on a drive circuit board located perpendicularly to the piezoelectric elements, instead of using a costly high-density FPC (flexible printed circuit).

Furthermore, for example, Japanese Patent Application Publication No. 2003-127366 also discloses an inkjet print head. It is an object of such an inkjet print head to maintain the good ink ejection performance, and to reduce the head size. In the inkjet print head, pressure chambers connected to nozzle apertures are formed in a flow channel forming substrate; and a reservoir forming substrate (piezoelectric element cover) is bonded to the same side of the flow channel forming substrate as the piezoelectric elements. The reservoir forming substrate seals off a free space in the region which opposes the piezoelectric elements and does not block the movement of the piezoelectric element. An electrical wire is provided on the inner surface of the reservoir forming substrate, and by bonding it with the flow channel forming substrate, the wire is electrically connected with the common electrode of the piezoelectric elements.

However, in such a head described in Japanese Patent Application Publication No. 9-314833, since the wires from the piezoelectric elements are extended horizontally and connected to the TFTs, wiring of high-density for the arrangement of the piezoelectric elements corresponding to 1000 dpi (dots per inch) or more is difficult to be achieved. Furthermore, in such a head described in Japanese Patent Application Publication No. 2003-127366, the electrical wires are provided on the inner surface of the reservoir forming substrate (piezoelectric element cover). Accordingly, though the head is prevented from becoming large in size, it is difficult to achieve high-density wiring.

For example, in a full line head which covers the whole width of the recording medium, if the piezoelectric elements are arranged in a matrix configuration in order to achieve a high-density arrangement of 2400 dpi, then it is required to extend each wire from each of the piezoelectric elements. In this case, the line intervals between the wires are 10 μm or less, and it is difficult to achieve such high-density on the basis of a method where the wires are formed by etching or plating.

SUMMARY OF THE INVENTION

The present invention has been contrived in view of the foregoing circumstances, an object thereof being to provide a liquid ejection head and a method of manufacturing a liquid ejection head wherein wires for supplying drive signals to the piezoelectric elements can be arranged at high density, and the reliability of bonding can be improved.

In order to attain the aforementioned object, the present invention is directed to a liquid ejection head, comprising: a plurality of pressure chambers which contain liquid and are arranged in a two-dimensional matrix configuration; a plurality of nozzles which connect to the pressure chambers and eject the liquid; a diaphragm which forms one face of the pressure chambers; a plurality of piezoelectric elements which are formed on a face of the diaphragm reverse to a face thereof adjacent to the pressure chambers, each of the piezoelectric elements corresponding to each of the pressure chambers; a plurality of electrical wires which connect to the piezoelectric elements and extend in a direction substantially perpendicular to the face on which the piezoelectric elements are formed; a sealing member which seals off at least one of the piezoelectric elements and at least one of the electrical wires so that space is formed over a side of the at least one of the piezoelectric elements reverse to a side adjacent to the diaphragm; and a common liquid chamber which supplies the liquid to the pressure chambers and is arranged on a side of the sealing member reverse to a side thereof on which the pressure chambers are arranged.

According to this aspect of the present invention, it is possible to achieve the electrical connections with the piezoelectric elements and the insulation from the liquid chamber, without obstructing the driving of the piezoelectric elements.

Preferably, the sealing member is formed by resin molding.

Alternatively, it is also preferable that the sealing member is formed on the diaphragm by insert molding.

Preferably, the sealing member collectively seals at least two of the piezoelectric elements.

By covering a plurality of piezoelectric elements so that they are contained within one sealing member, it is possible to reduce the bonding surface area between the diaphragm and the sealing member. Consequently, it is possible to improve the reliability of the bond between the sealing member and the diaphragm.

Preferably, the piezoelectric elements collectively sealed are arranged in one row direction.

Alternatively, it is also preferable that the liquid ejection head further comprises: a liquid supply channel through which the liquid is supplied from the common liquid chamber to at least one of the pressure chambers, wherein the piezoelectric elements collectively sealed include at least two piezoelectric elements arranged in a longitudinal direction and at least two piezoelectric elements arranged in a lateral direction.

Accordingly, the reliability of the bond between the sealing member and the diaphragm is improved.

In order to attain the aforementioned object, the present invention is also directed to a method of manufacturing a liquid ejection head which comprises a plurality of pressure chambers which contain liquid and are arranged in a two-dimensional matrix configuration; a plurality of nozzles which connect to the pressure chambers and eject the liquid; a diaphragm which forms one face of the pressure chambers; a plurality of piezoelectric elements which are formed on a face of the diaphragm reverse to a face thereof adjacent to the pressure chambers, each of the piezoelectric elements corresponding to each of the pressure chambers; and a plurality of electrical wires which connect to the piezoelectric elements and extend in a direction substantially perpendicular to the face on which the piezoelectric elements are formed, the method comprising the steps of: forming a sealing member integrally by resin molding, the sealing member sealing off at least one of the piezoelectric elements and at least one of the electrical wires so that space is formed over a side of the at least one of the piezoelectric elements reverse to a side adjacent to the diaphragm; and bonding the sealing member onto the diaphragm on which the piezoelectric elements are formed so that the piezoelectric elements are located in the space.

According to this aspect of the present invention, it is possible to readily manufacture a liquid ejection head that can achieve the electrical connections with the piezoelectric elements and the insulation from the liquid chamber, without obstructing the driving of the piezoelectric elements.

In order to attain the aforementioned object, the present invention is also directed to a method of manufacturing a liquid ejection head which comprises a plurality of pressure chambers which contain liquid and are arranged in a two-dimensional matrix configuration; a plurality of nozzles which connect to the pressure chambers and eject the liquid; a diaphragm which forms one face of the pressure chambers; a plurality of piezoelectric elements which are formed on a face of the diaphragm reverse to a face thereof adjacent to the pressure chambers correspondingly to the pressure chambers; and a plurality of electrical wires which connect to the piezoelectric elements and extend in a direction substantially perpendicular to the face on which the piezoelectric elements are formed, the method comprising the steps of: forming a protective layer so as to cover a periphery of each of the piezoelectric elements formed on the diaphragm; and then forming a sealing member integrally onto the diaphragm by insert molding, the sealing member sealing off at least one of the piezoelectric elements and at least one of the electrical wires so that space is formed over a side of the at least one of the piezoelectric elements reverse to a side adjacent to the diaphragm.

According to this aspect of the present invention, it is possible to readily manufacture a liquid ejection head that can achieve electrical connections with the piezoelectric elements and the insulation from the liquid chamber, and improve the sealing properties of the piezoelectric elements, without obstructing the driving of the piezoelectric elements.

As described above, according to the liquid ejection head and the method of manufacturing the liquid ejection head based on the present invention, it becomes possible to achieve the high-density arrangement of piezoelectric elements, and furthermore, to achieve the electrical connections with the piezoelectric elements and the insulation from the liquid chamber without obstructing the driving of the piezoelectric elements.

BRIEF DESCRIPTION OF THE DRAWINGS

The nature of the present invention, as well as other objects and benefits thereof, are explained in the following with reference to the accompanying drawings, wherein.

DETAILED DESCRIPTION OF THE PREFERRED EMBODIMENTS

Figure 1:
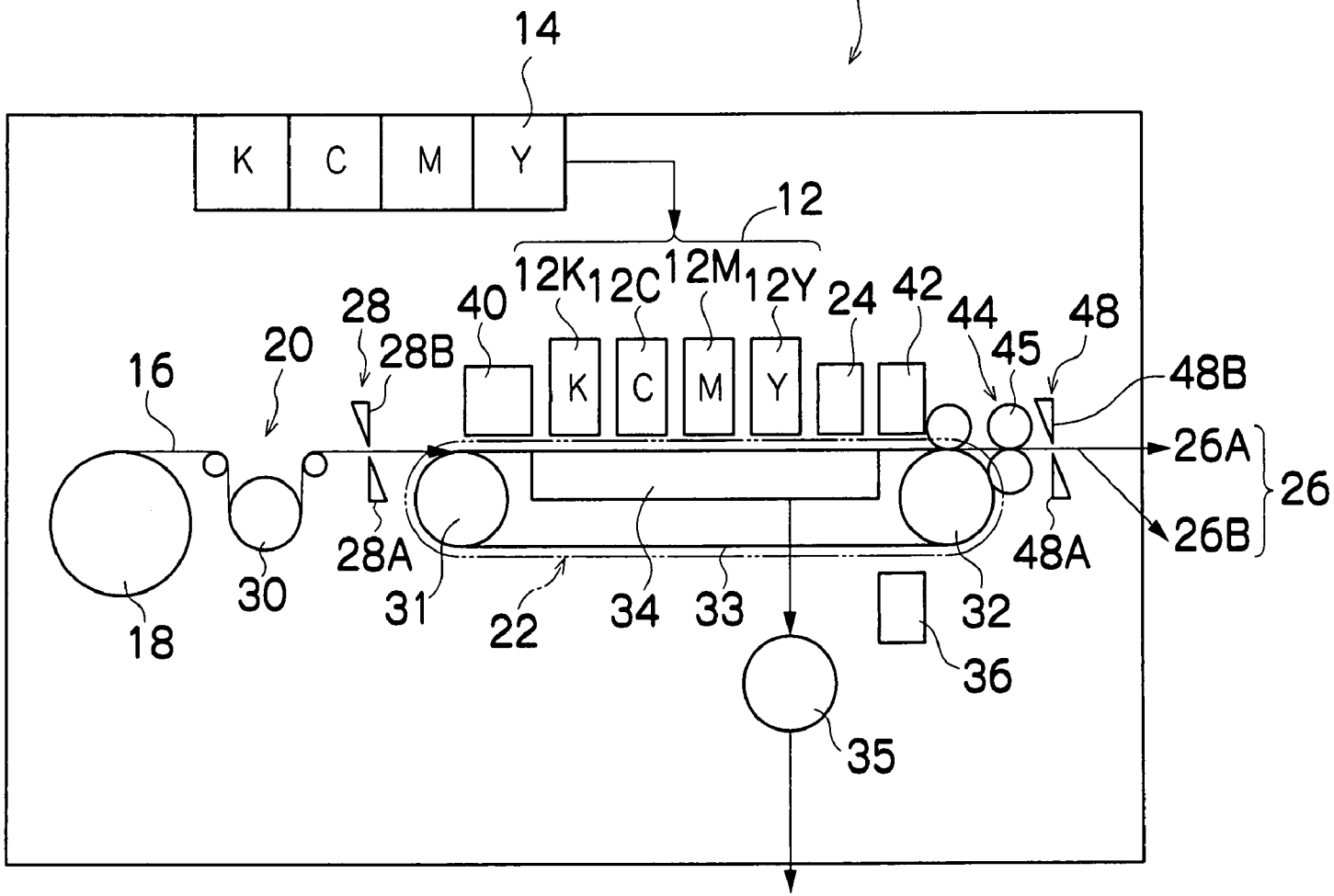
FIG. 1 is a general schematic drawing showing an approximate view of an inkjet recording apparatus forming an image forming apparatus with a liquid ejection head according to a first embodiment of the present invention.

FIG. 1 is a general schematic drawing showing an approximate view of an inkjet recording apparatus forming an image forming apparatus having a liquid ejection head according to a first embodiment of the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed before the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
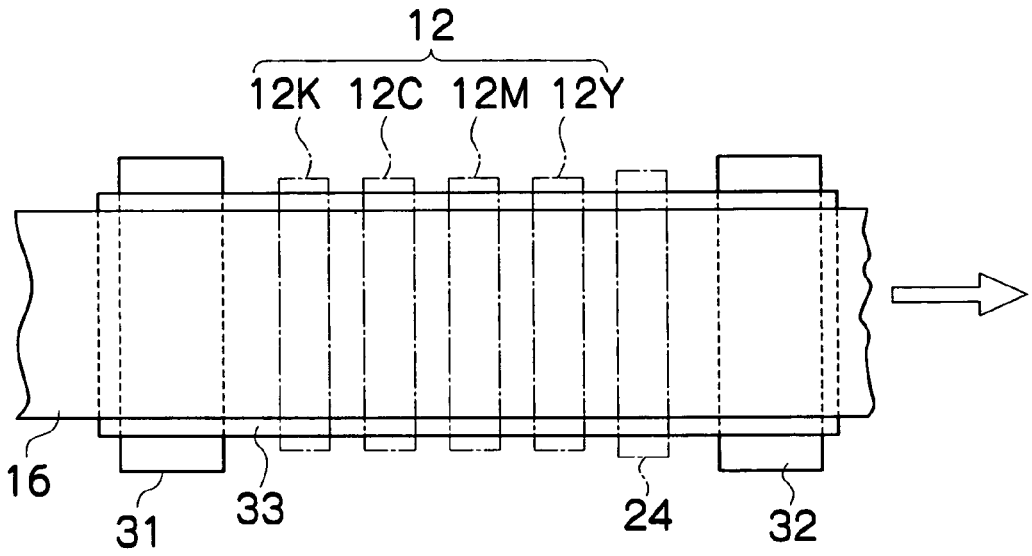
FIG. 2 is a plan view of the principal part of the peripheral area of a print unit in the inkjet recording apparatus shown in FIG. 1.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

As shown in FIG. 2, the print heads 12K, 12C, 12M and 12Y are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (left side in FIG. 1), in the conveyance direction of the recording paper 16 (paper conveyance direction). A color image can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) which is perpendicular to the paper conveyance direction.

The terms "main scanning direction" and "sub-scanning direction" here are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3:
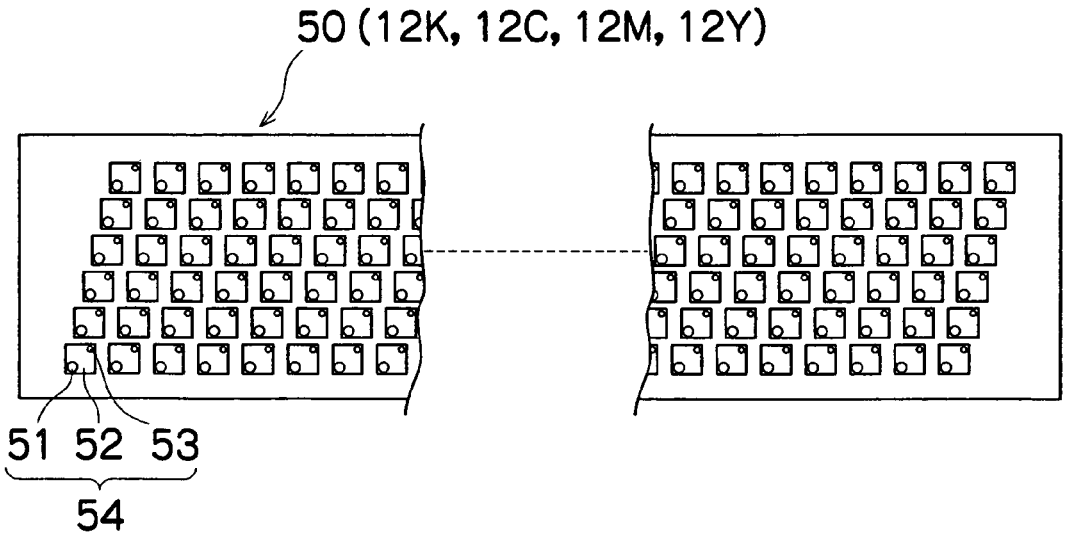
FIG. 3 is a plan perspective diagram showing an example of the structure of a print head.

Next, the arrangement of nozzles (liquid ejection ports) in the print head (liquid ejection head) is described below. The print heads 12K, 12C, 12M and 12Y provided for the respective ink colors have the same structure, and a print head forming a representative example of these print heads is hereinafter denoted with a reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

Although there are no particular limitations on the size of the nozzle arrangement in the print head 50 of this kind, 2400 npi (nozzles per inch) can be achieved by arranging the nozzles 51 in 48 lateral rows in 21 mm and 600 vertical columns in 305 mm, as one example.

In the example shown in FIG. 3, each of the pressure chambers 52 has an approximately square planar shape when viewed from above; however, the planar shape of the pressure chambers 52 is not limited to a square shape. As shown in FIG. 3, the nozzle 51 is formed at one end of the diagonal of each pressure chamber 52, and the ink supply port 53 is provided at the other end thereof.

Figure 4:
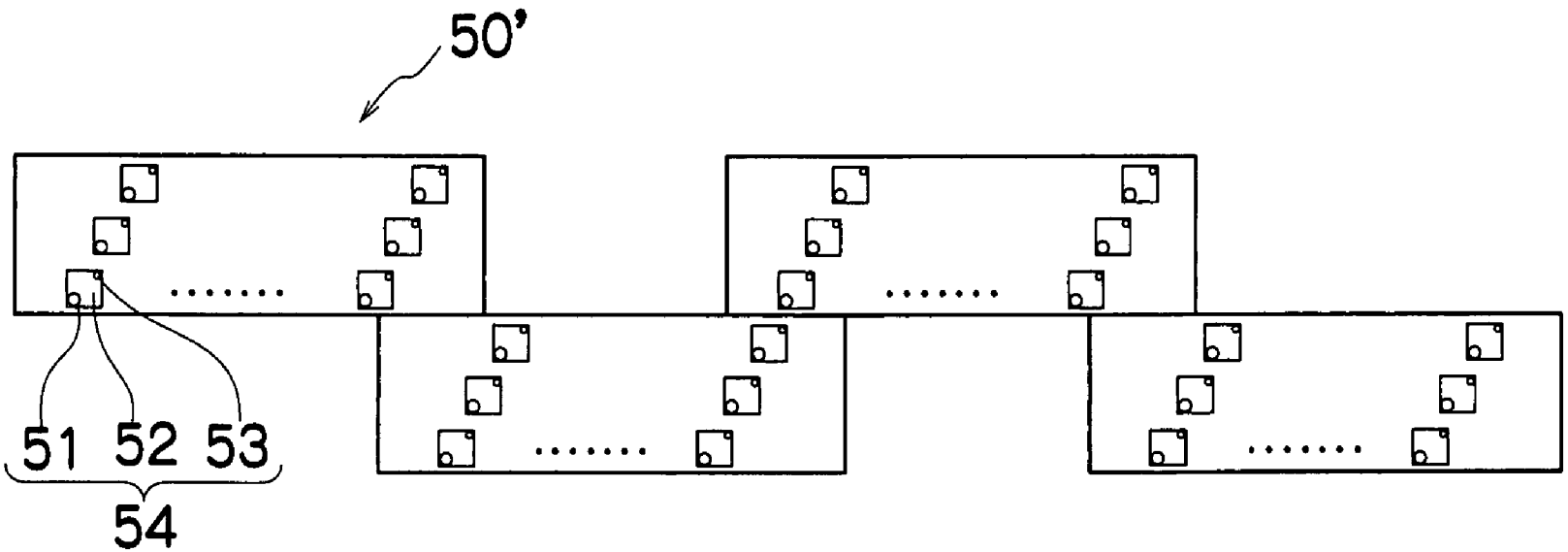
FIG. 4 is a plan view showing a further example of a print head.

Moreover, FIG. 4 is a plan view perspective diagram showing a further embodiment of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
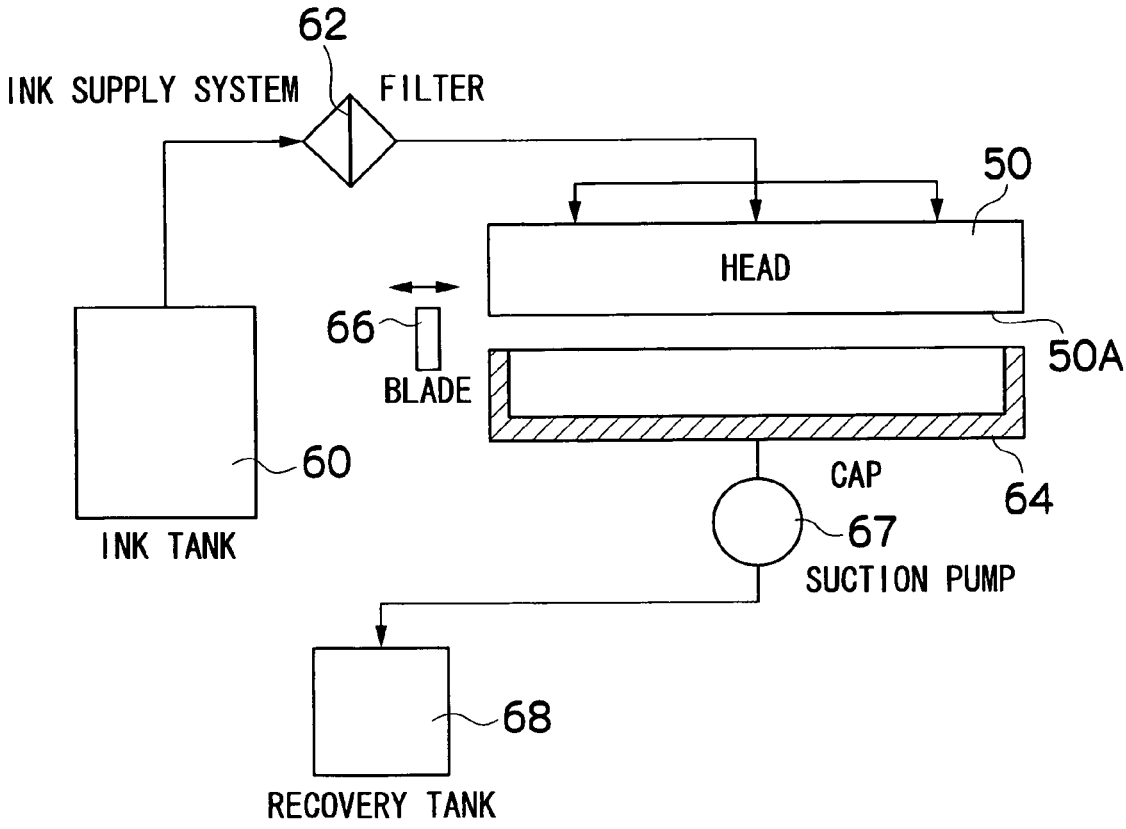
FIG. 5 is a schematic drawing showing the composition of an ink supply system in the inkjet recording apparatus.

FIG. 5 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a recovery tank 68. This suction operation is also carried out in order to suction and remove degraded ink which has hardened due to increasing in viscosity when ink is loaded into the print head for the first time, and when the print head starts to be used after having been out of use for a long period of time.

More specifically, when a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the pressure generating device (not shown, described below) for the ejection driving is operated. Before reaching such a state (in a viscosity range that allows ejection by the operation of the pressure generating device) the pressure generating device is operated to perform the preliminary discharge to eject the ink whose viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as described above.

More specifically, when bubbles have become intermixed into the ink inside the nozzles 51 and the pressure chambers 52, or when the ink viscosity in the nozzle 51 increases beyond a certain level, ink can no longer be ejected from the nozzles even if the laminated pressure generating devices are operated. In a case of this kind, a cap 64 is placed on the nozzle surface 50A of the print head 50, and the ink containing air bubbles or the ink of increased viscosity inside the pressure chambers 52 is suctioned by a pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small. The cap 64 shown in FIG. 5 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 6:
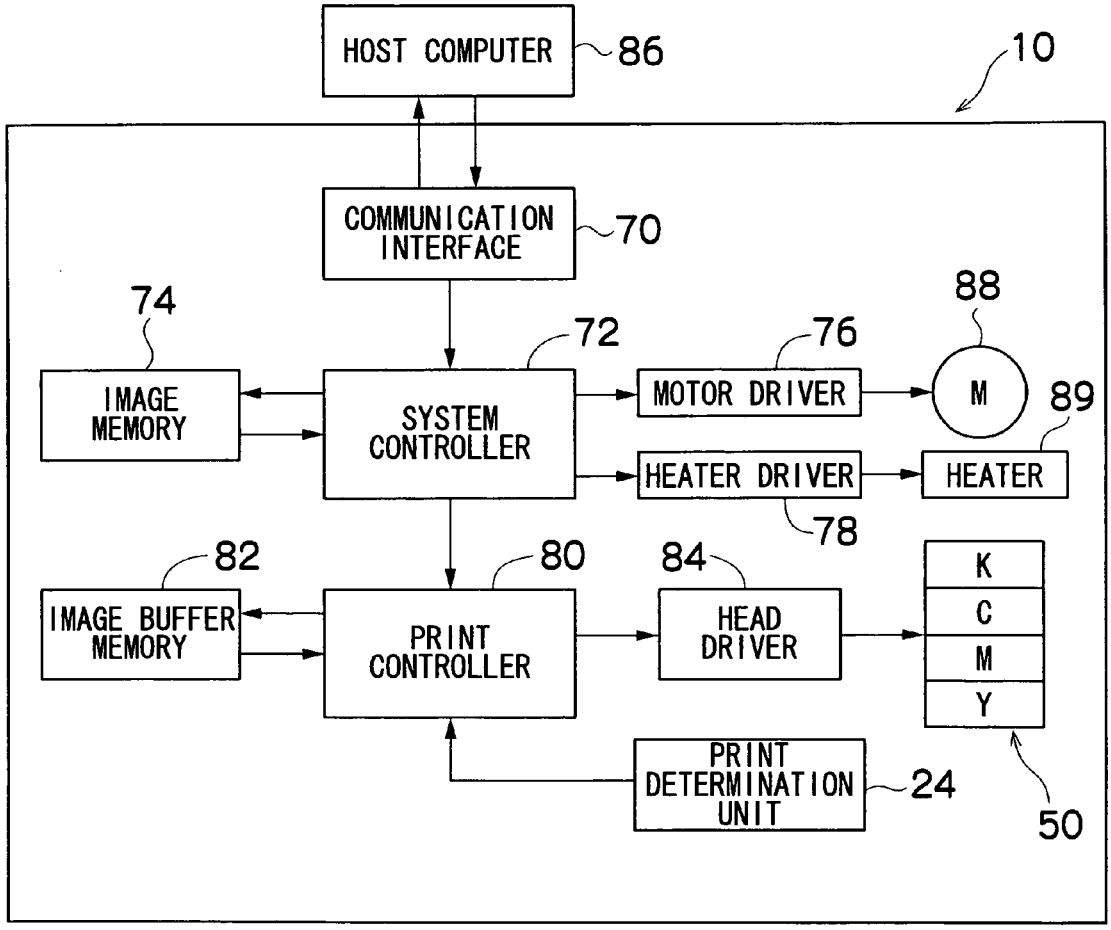
FIG. 6 is a partial block diagram showing the system composition of an inkjet recording apparatus.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the pressure generating device of the print heads 50 of the respective colors on the basis of print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, the liquid ejection head (print head 50) in which the wires for supplying drive signals are formed at high density, which is one of the features of the present invention, is described in detail.

In the present embodiment, in order to achieve high density in the print head, firstly, a high-density arrangement of the nozzles 51 is obtained (for example, 2400 npi (nozzles per inch)) by arranging the pressure chambers 52 (the nozzles 51) in the form of a two-dimensional matrix, as shown in FIG. 3, for example. Thereupon, as described in more detail below, in the present embodiment, the ink supply system is integrated to a high degree by disposing the common liquid chamber for supplying ink to the pressure chambers 52 above the diaphragm, and by eliminating pipes which produce flow resistance, in such a manner that the ink is supplied directly from this common liquid chamber to the pressure chambers 52 in view of prioritizing ink refilling characteristics. Furthermore, in the present embodiment, each of the electrical wirings which supply drive signals to the electrodes (individual electrodes) of the pressure generating devices that deform the pressure chambers 52, rises upwards vertically from each individual electrode so as to pass through the common liquid chamber and is connected to upper wiring, such as a flexible cable.

Figure 7:
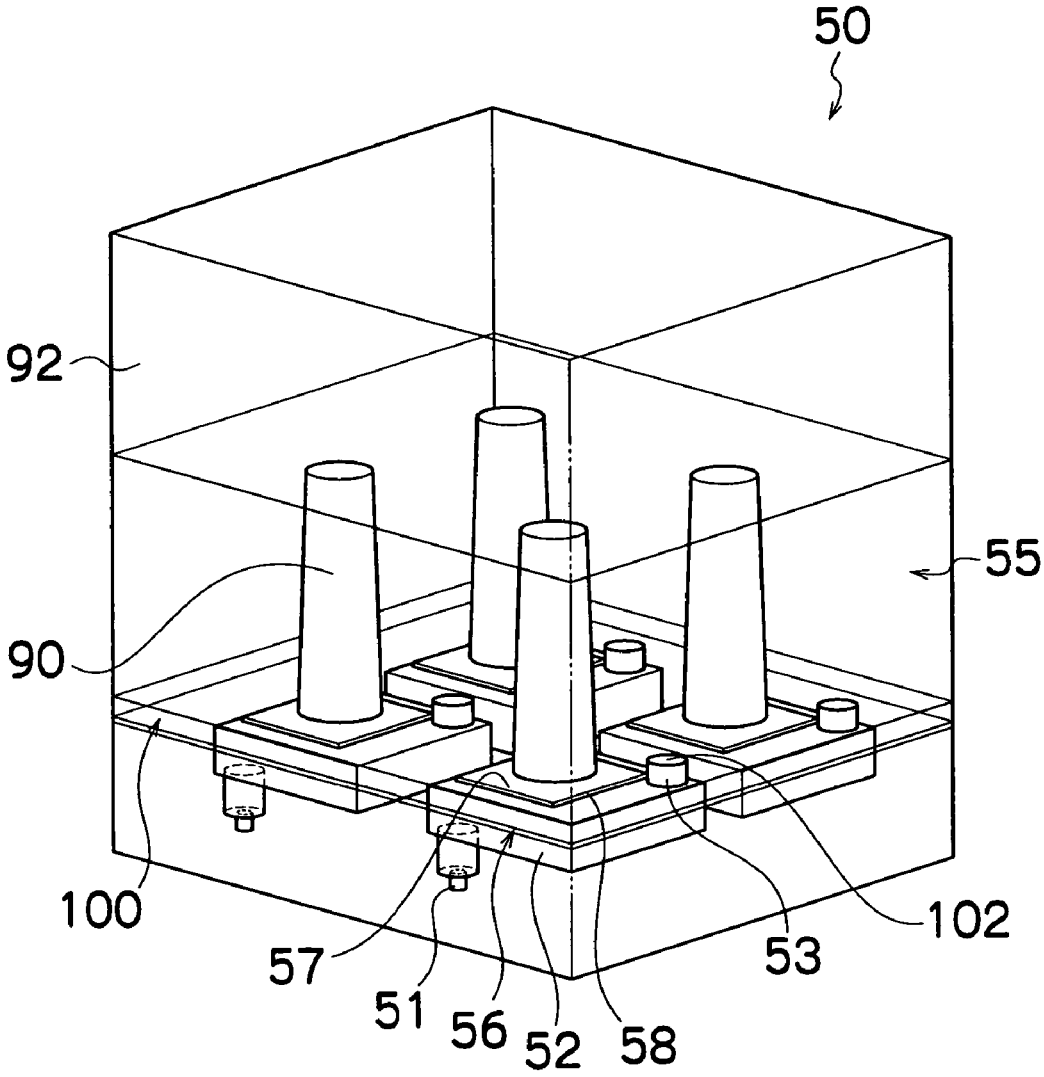
FIG. 7 is an oblique perspective diagram showing a partial enlarged view of the print head.

FIG. 7 shows a simplified oblique perspective view of a part of the print head 50 having such a high density configuration.

As shown in FIG. 7, in the print head 50 according to the present embodiment, a diaphragm 56 which forms the upper surface of the pressure chambers 52 is disposed on the upper side of the pressure chambers 52, each of which is connected to the nozzle 51 and the ink supply port 53. Piezoelectric elements (piezoelectric actuators) 58 forming the pressure generating devices are disposed on the diaphragm 56 at positions corresponding to the pressure chambers 52. Each of the piezoelectric elements 58 is constituted by a piezoelectric body made of lead zirconate titanate (PZT), for example, and sandwiched between the upper and lower electrodes. An individual electrode 57 is formed on each piezoelectric element 58, and the diaphragm 56 also serves as a common electrode. Each of the piezoelectric elements 58 is sandwiched from above and below, between the individual electrode 57 and the common electrode (diaphragm 56). By supplying drive signals to the individual electrode 57 and the common electrode (diaphragm 56), the piezoelectric element 58 is driven.

A piezoelectric element cover 100 is disposed on top of the diaphragm 56, on which the piezoelectric elements 58 and the like are disposed. Although described in more detail below, the piezoelectric element cover 100 covers and protects the piezoelectric elements 58, and also forms cavities so as to facilitate driving of the piezoelectric elements 58.

Furthermore, column-shaped wiring members 90, which rise up in a substantially perpendicular direction with respect to the diaphragm 56, are formed on the piezoelectric element cover 100, and a multi-layered flexible cable 92 is disposed on top of the wiring members 90. Moreover, as described in detail below, electrical wires that electrically connect the individual electrodes 57 of the piezoelectric elements 58 with the multi-layered flexible cable 92 are formed inside the column-shaped wiring members 90.

The space in which the column-shaped wiring members 90 are formed between the piezoelectric element cover 100 and the multi-layered flexible cable 92 serves as a common liquid chamber 55 for supplying ink to the pressure chambers 52. In order to supply ink to the pressure chambers 52 from the common liquid chamber 55, holes 102 are formed in the piezoelectric element cover 100, and these holes 102 pierce through the diaphragm 56 and are connected to the ink supply ports 53.

In the present embodiment, by combining the piezoelectric element cover 100 and the wiring members 90 to form an integrated sealing member that seals the piezoelectric elements and also seals the electrical wires, it is possible to increase the wiring density, in order to improve the reliability of the piezoelectric element cover 100 and the electrical wires in the wiring members 90 and to ensure the insulating properties more readily.

The common liquid chamber 55 shown here is one large space formed throughout the whole region where the pressure chambers 52 are formed in such a manner that the common liquid chamber 55 supplies ink to all of the pressure chambers 52 as shown in FIG. 3; however, the common liquid chamber 55 is not necessarily limited to be formed as one space. For example, a plurality of chambers may be formed by dividing the space into a plurality of spaces.

Furthermore, the wiring members 90 described here are formed in a one-to-one correspondence with the individual electrodes 57 of the piezoelectric elements 58; however, in order to reduce the number of the column-shaped wiring members 90 disposed in the common liquid chamber 55, it is also possible to group together the wires corresponding to several piezoelectric elements 58 and put the wires inside one wiring member 90. By reducing the number of wiring members 90 inside the common liquid chamber 55 in this way, it is possible to reduce the resistance acting on the ink flowing inside the common liquid chamber 55, and to reduce the adherence of air bubbles inside the ink to the column-shaped wiring members.

The diaphragm 56 is formed as a single plate, which is common to all of the pressure chambers 52. Each of the piezoelectric elements 58 for deforming the pressure chambers 52 is disposed on the diaphragm 56 in the position corresponding to each of the pressure chambers 52. The electrodes (the common electrode (diaphragm 56) and the individual electrode 57) for driving the piezoelectric element 58 by applying a voltage to the piezoelectric element 58 are formed on the upper and lower surfaces of each piezoelectric element 58, accordingly each of the piezoelectric elements 58 being sandwiched. The diaphragm 56 is formed by a conductive thin film, such as a stainless steel film, in such a manner that it can also serve as the common electrode.

Although the piezoelectric element cover 100 is also formed by a single plate, which is common to all of the piezoelectric elements 58, the shape of the piezoelectric element cover 100 is not limited to this. It is also possible to dispose piezoelectric element covers each of which corresponds to several piezoelectric elements. Such an example is described in more detail below.

Furthermore, the common liquid chamber 55 is filled with ink. Hence, although not shown in FIG. 7, of the diaphragm forming the common electrode 56, the individual electrodes 57, the wiring members 90 and the multi-layer flexible cable 92, each of the surfaces which make contact with the ink is covered with an insulating protective film.

Although there are no particular restrictions on the size of the print head 50 described above, one embodiment is given below. In the one embodiment, the planar shape of the pressure chambers 52 is an approximately square shape of 300 μm×300 μm (of which corners are curved in order to prevent the ink flow from stagnating there), the height of the pressure chambers is 150 μm, the diaphragm 56 and the piezoelectric elements 58 each have a thickness of 10 μm, the wiring members 90 have a diameter of 100 μm at the connection with the piezoelectric element cover 100, and the height of each of the wiring members 90 is 500 μm.

Figure 8:
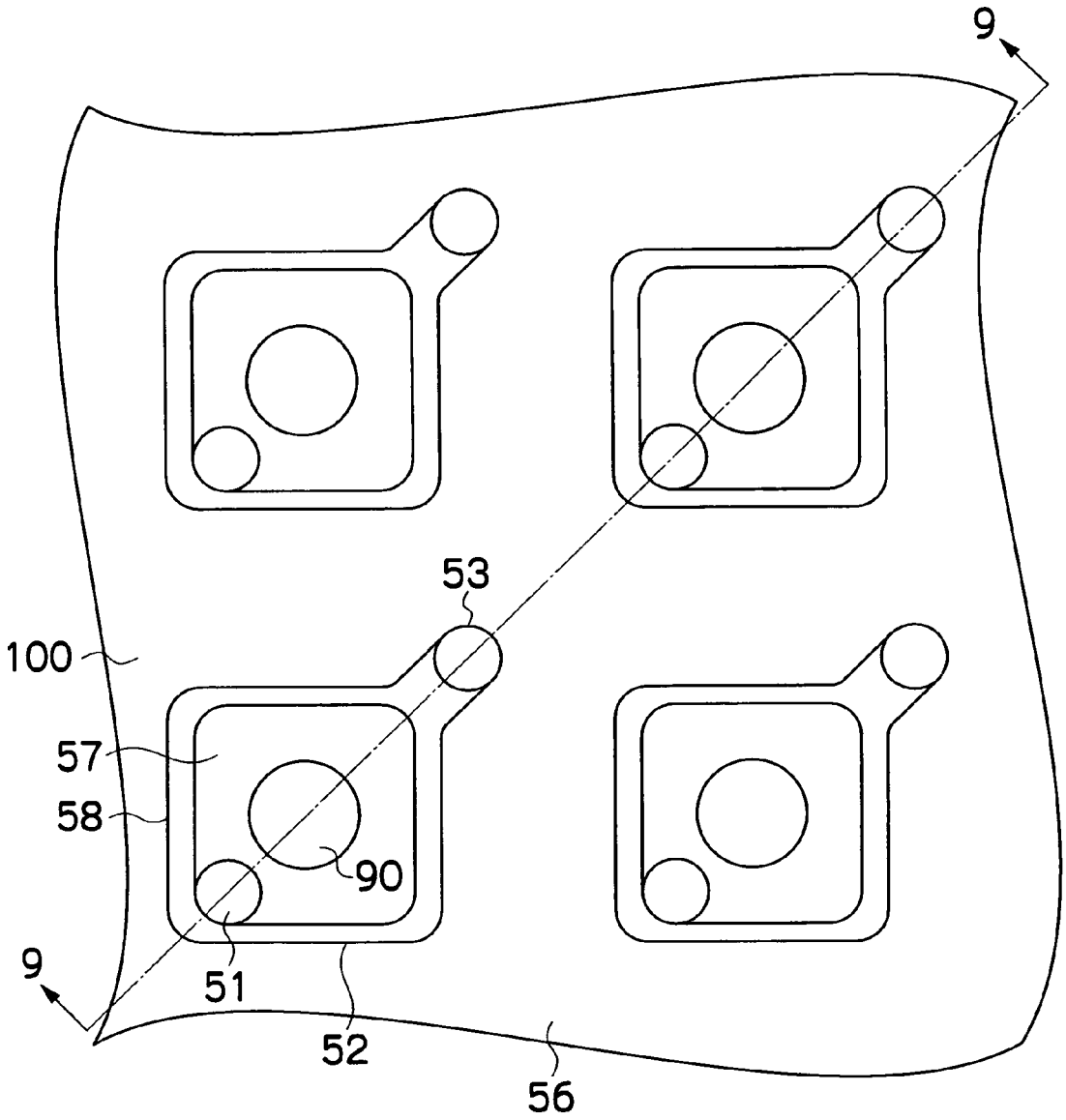
FIG. 8 is a plan view perspective diagram showing an enlarged view of a portion of a pressure chamber.

FIG. 8 is an enlarged plan view perspective diagram showing a part of such pressure chambers 52. As stated above, the pressure chambers 52 each have a substantially square shape, and the nozzle 51 and the ink supply port 53 are formed at respective corners on a diagonal of this shape. The diaphragm 56 is arranged on the pressure chambers 52 so as to form the upper face of the pressure chambers 52. The piezoelectric elements 58 and the individual electrodes 57 are formed on the diaphragm 56 in the regions corresponding to the pressure chambers 52. The piezoelectric element cover 100 is disposed thereon so as to cover these elements. The wiring members 90 are formed on the piezoelectric element cover 100 in such a manner that the wiring members 90 rise upward in a substantially perpendicular fashion from the surface on which the piezoelectric elements 58 are formed.

Figure 9:
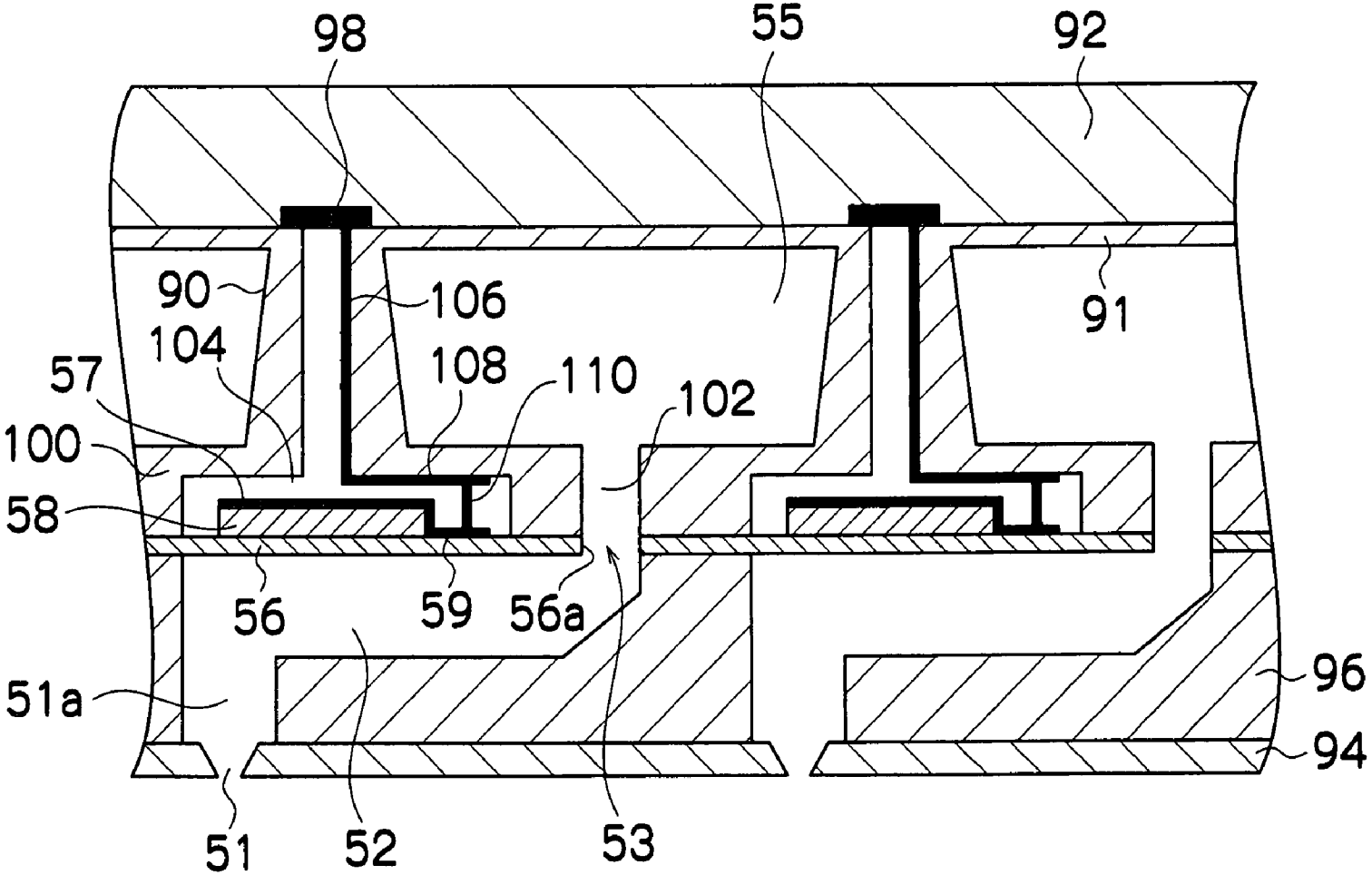
FIG. 9 is a cross-sectional diagram along line 9-9 in FIG. 8.

FIG. 9 is a cross-sectional diagram along line 9-9 in FIG. 8.

As shown in FIG. 9, the print head 50 according to the first embodiment is formed by arranging a plurality of thin plates to overlap each other. Firstly, a flow channel plate 96 provided with the pressure chambers 52, the ink supply ports 53 and nozzle flow channels 51*a* linking the pressure chambers 52 and the nozzles 51, is arranged on a nozzle plate 94 provided with the nozzles 51. Although the flow channel plate 96 is depicted as a single plate in FIG. 9, it is also possible in practice that the flow channel plate 96 is laminated from a plurality of thin plates.

The diaphragm 56 forming the ceiling faces of the pressure chambers 52 is arranged on the flow channel plate 96. Desirably, the diaphragm 56 also serves as the common electrode for driving the piezoelectric elements 58 as described below, in conjunction with the individual electrodes 57. Opening sections 56*a* are provided in the diaphragm 56 in positions corresponding to the ink supply ports 53 of the pressure chambers 52.

The piezoelectric elements 58 are formed on the diaphragm 56 (common electrode) in regions corresponding respectively to approximately the whole upper surfaces of the pressure chambers 52. Each individual electrode 57 is formed on the upper surface of each piezoelectric element 58. The piezoelectric element 58 thus sandwiched between the lower common electrode (diaphragm 56) and the upper individual electrode 57 reduces the volume of the pressure chamber 52 by deforming when a voltage is applied through the common electrode 56 and the individual electrode 57, thereby causing ink to be ejected from the nozzle 51.

The piezoelectric element cover 100 is formed on the diaphragm 56 so as to cover the piezoelectric elements 58 and the individual electrodes 57 arranged on the diaphragm 56. The piezoelectric element cover 100 protects the piezoelectric elements 58. In order to facilitate the driving of the piezoelectric elements 58, cavity sections 104 are formed in the piezoelectric element cover 100 in regions of the piezoelectric elements 58. Furthermore, holes 102 corresponding to the ink supply ports 53 are also provided in the piezoelectric element cover 100, and the holes 102 and the opening sections 56*a* of the diaphragm 56 are connected to each other, and thereby the ink supply ports 53 are formed. Ink is supplied from the common liquid chamber 55 to the pressure chambers 52 through the ink supply ports 53.

The wiring members 90 are formed in a column shape on the piezoelectric element cover 100 so as to rise up in a substantially perpendicular fashion with respect to the surface on which the piezoelectric elements 58 are formed. As described below, the wiring members 90 are formed integrally with the piezoelectric element cover 100. The multi-layered flexible cable 92 is formed on the wiring members 90 and the space defined by the piezoelectric element cover 100 and the multi-layered flexible cable 92 through the wiring members 90 constitutes the common liquid chamber 55.

The interior of the wiring members 90 is hollow in order to form electrical wires which provide electrical connections between the individual electrodes 57 of the piezoelectric elements 58 and the electrodes 98 of the multi-layered flexible cable 92. In practice, as shown in FIG. 9, the electrical connections are obtained: by extending electrode pads 59 from the individual electrodes 57 on the piezoelectric elements 58, onto an insulating film on the diaphragm 56; by forming electrical wires 106 by plating, or the like, inside the wiring members 90; by connecting these electrical wires 106 to wires 108 formed inside the hollow sections 104 of the piezoelectric element cover 100; and then by connecting the wires 108 and the electrode pads 59 by solder 110, or the like. Although each electrical wire 106 is disposed in a portion of each wiring member 90 in FIG. 9, it is also possible that the interiors of the wiring members 90 are completely filled with the electrical wires 106.

Accordingly, the wires (not shown) which are formed in the multi-layered flexible cable 92 are connected to the electrical wires 106 through the electrodes 98, and drive signals for driving the piezoelectric elements 58 are supplied through the electrical wires 106, and the like.

In this way, in the present embodiment, the common liquid chamber, which is usually located on the same side of the diaphragm as the pressure chambers, is formed on the upper side of the diaphragm, and consequently the common liquid chamber is located on the side of the diaphragm reverse to the pressure chambers. Accordingly, it is not necessary to provide channels and the like for guiding the ink from the common liquid chamber to the pressure chambers, as required in the usual apparatus, and furthermore, the size of the common liquid chamber can be increased and hence the ink can be steadily supplied.

Moreover, the wiring members which enclose the electrical wires that supply the drive signals to the piezoelectric elements are formed in a column shape so as to rise up in a substantially perpendicular direction with respect to the surface on which the piezoelectric elements are formed. Furthermore, these wiring members are formed integrally with the piezoelectric element cover which secures and seals a space around each piezoelectric element, thereby protecting the piezoelectric elements and facilitating their driving action. Hence, the density of the wiring is increased, and the reliability and insulation characteristics of the electrical wires can be improved.

Next, a method of integrally forming the piezoelectric element cover 100 and the wiring members 90, which seal these piezoelectric elements 58 and the electrical wires in, is described below.

Figure 10A:
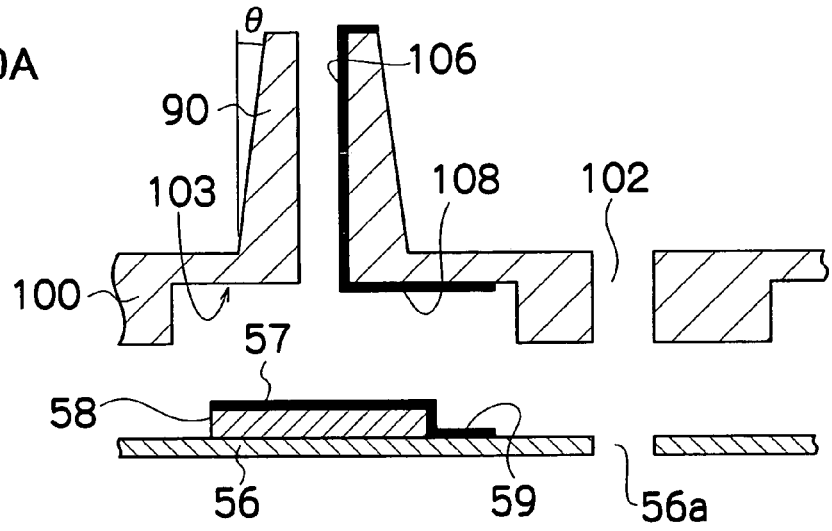
FIGS. 10A to 10C are illustrative diagrams showing steps for manufacturing the print head according to the first embodiment.
Figure 10B:
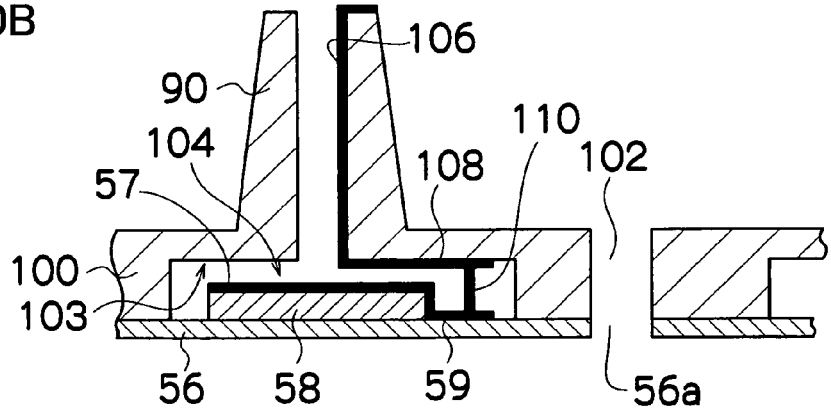
Figure 10C:
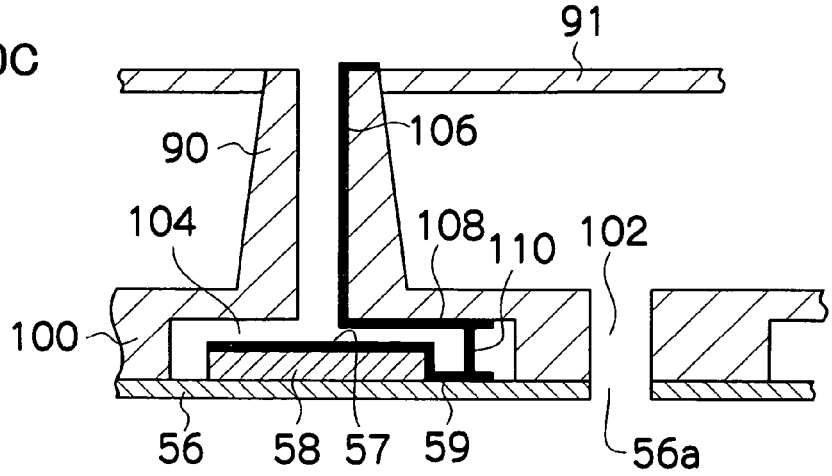

FIGS. 10A to 10C show steps for integrally forming the piezoelectric element cover 100 and the wiring members 90 according to the present embodiment.

Firstly, as shown in FIG. 10A, the piezoelectric element cover 100 and the wiring members 90 are integrally formed while the diaphragm 56 and the piezoelectric elements 58 are separately formed.

As a method of integrally forming the piezoelectric element cover 100 and the wiring members 90, resin molding may be suitable, since it is capable of producing integral three-dimensional structures at low cost. Desirably, the resin material is a thermosetting resin having excellent dimensional accuracy, such as epoxy resin, phenol resin, polyimide resin, or the like, and of these, epoxy resin is particularly desirable due to its excellent resistance to ink. In order to improve rigidity, a silica or alumina filler is desirably introduced into the epoxy resin, thereby making it possible to maintain the strength as the head structure assembly.

When the piezoelectric element cover 100 and the wiring members 90 are formed integrally, the piezoelectric element cover 100 is provided with recess sections 103 which are to create the cavity sections for ensuring that the piezoelectric elements 58 can be driven freely, and the holes 102 corresponding to the ink supply ports 53. Furthermore, each of the wiring members 90 is provided with a hollow interior, in order to form the electrical wires inside the wiring members 90. The wiring members 90 are formed with a tapered shape having a taper angle of θ, so as to be narrower at the upper side than at the lower side, as shown in FIGS. 10A to 10C, since the wiring members 90 are removed from the mold after the resin molding. The larger this taper angle θ becomes, the more easily it becomes to separate the resin from the mold; however, if the taper angle θ is too large, then the volume of the wiring members 90 also becomes large, thus reducing the size of the common liquid chamber 55. Therefore, the taper angle of 1° through 20° is used, and more desirably, an angle of 5° through 15° is used.

After integrally forming the wiring members 90 and the piezoelectric element cover 100, the electrical wire 106 is formed in the interior of each wiring member 90, by means of a method such as plating, embedding of conductive paste, or the like. Furthermore, the wire 108 connected to this electrical wire 106 is formed inside each of the recess sections 103 which are to be the cavity sections.

Meanwhile, the diaphragm 56 is made from a thin plate of stainless steel, or the like. After providing an insulating treatment on the surface of the diaphragm 56, piezoelectric elements 58 are formed on the diaphragm 56. There are no particular restrictions on the method of forming the piezoelectric elements 58, and sputtering, aerosol deposition, bulk formation, or the like, may be used to form the piezoelectric elements 58. Furthermore, the individual electrodes 57 are formed on the piezoelectric elements 58 across the insulating film, and the wires are extended from the individual electrodes 57 to form the electrode pads 59 on top of the insulated diaphragm 56. The opening sections 56*a* corresponding to the ink supply ports 53 are also formed in the diaphragm 56.

Next, as shown in FIG. 10B, the piezoelectric element cover 100 and the wiring members 90 formed as described above are bonded to the diaphragm 56 provided with the piezoelectric elements 58 and the like, in adjusted positions, so that the holes 102 coincide with the opening sections 56*a* and the piezoelectric elements 58 are accommodated inside the recess sections 103 of the piezoelectric element cover 100. The epoxy adhesive may be used for this bonding step. Accordingly, the cavity sections 104, which facilitate the driving of the piezoelectric elements 58, are formed inside the piezoelectric element cover 100.

In this case, the wires 108 formed inside the recess sections 103 (cavity sections 104) of the piezoelectric element cover 100 and the electrode pads 59 formed on the diaphragm 56 are electrically connected by means of solder, conductive paste, or the like. Furthermore, the protective and insulating film is formed on the surfaces of the diaphragm 56, the piezoelectric element cover 100, the wiring members 90, and other elements, which can make contact with ink.

As shown in FIG. 10B, the sealing characteristics around the holes 102 and the opening sections 56*a* can be confirmed in the state where the piezoelectric element cover 100 and the wiring members 90 are bonded to the diaphragm 56, on which the piezoelectric elements 58 and the like are formed, by checking through a microscope, or the like, whether the holes 102 in the piezoelectric element cover 100 and the opening sections 56*a* in the diaphragm 56, which connect to the ink supply ports 53, are properly opened or not; or by checking that there is no leakage of liquid into the cavity sections 104 by making the liquid flow through the holes 102 and the opening sections 56*a*.

Next, an upper lid 91 is attached to the upper part of the wiring members 90, as shown in FIG. 10C. Although not shown in the drawings, ultimately, the flow channel plate 96 provided with the pressure chambers 52 bonded to the nozzle plate 94 having the nozzles 51 is attached to the lower side of the diaphragm 56, and the multi-layered flexible cable 92 is installed on the upper side of the wiring members 90 and the upper lid 91, thereby forming the print head (liquid ejection head) 50.

Next, a method of manufacturing the liquid ejection head (print head 50) according to a second embodiment of the present invention is described below.

In the second embodiment, in forming the piezoelectric element cover 100 and the wiring members 90 integrally, the piezoelectric element cover 100 and the wiring members 90 which are resin members are formed by insert molding, onto the diaphragm 56 made of a metal material.

According to this method, firstly the piezoelectric elements 58 are formed on the diaphragm 56 in positions corresponding to the pressure chambers 52, and then a protective layer (sacrificial layer) is formed by performing the patterning on the periphery of the piezoelectric elements 58 in order to form the cavity sections 104 later in the piezoelectric element cover 100.

Figure 11A:
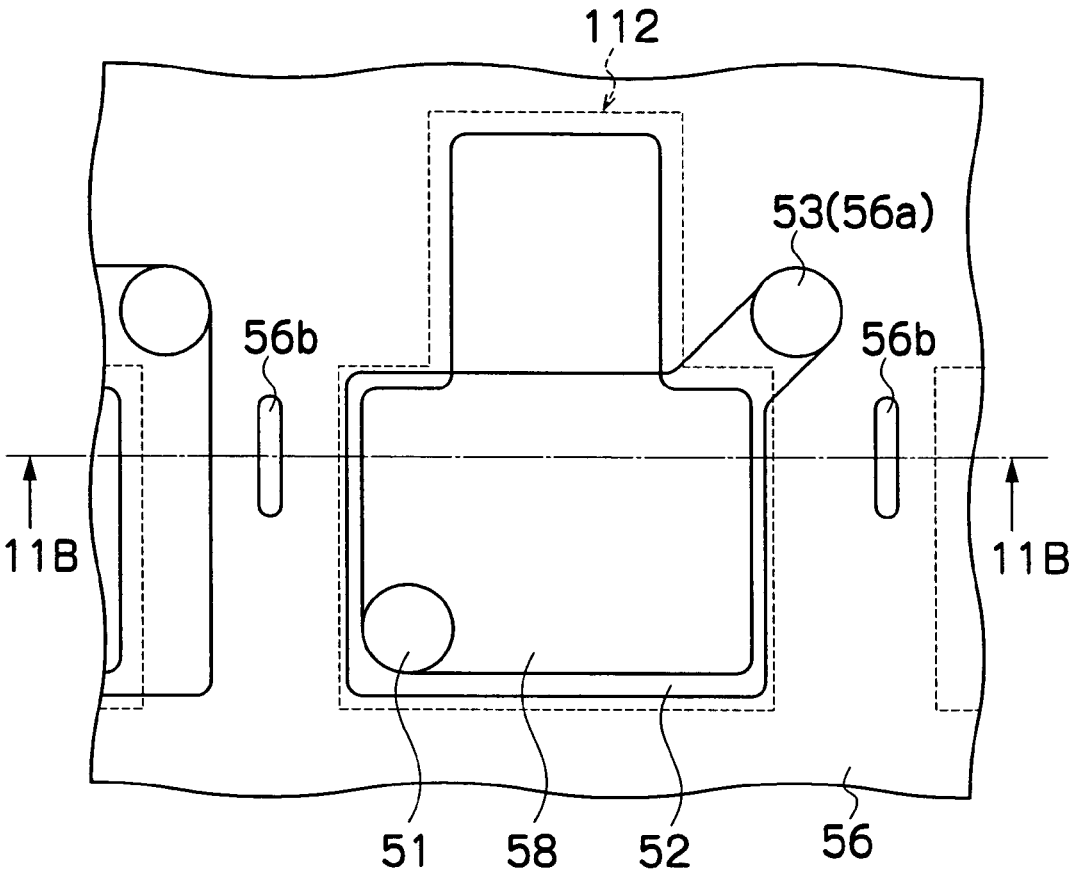
FIG. 11A is a plan view perspective diagram of the periphery of a piezoelectric element showing a piezoelectric element cover according to a second embodiment of the present invention.
Figure 11B:
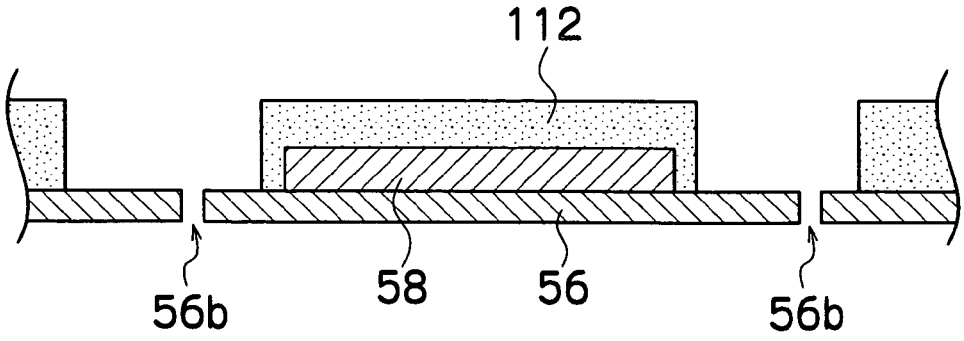
FIG. 11B is a cross-sectional diagram along line 11B-11B in FIG. 11A.

FIGS. 11A and 11B show this situation. FIG. 11A is a plan view perspective diagram showing the periphery of the piezoelectric element 58, and FIG. 11B is a cross-sectional diagram along line 11B-11B in FIG. 11A. In FIG. 11A, the pressure chamber 52, the nozzle 51 and the ink supply port 53 are depicted for the purpose of description, and in FIG. 11B, only the parts above the diaphragm 56 is shown.

As shown in FIG. 11A, the piezoelectric elements 58 are arranged on the diaphragm 56 in a matrix configuration so as to correspond to the pressure chambers 52. Moreover, molding holes 56*b* for allowing the molding resin forming the piezoelectric element cover 100 to flow around to the rear side of the diaphragm 56, are provided between the adjacent piezoelectric elements 58. Accordingly, it is possible to ensure the reliable bonding between the diaphragm 56 and the piezoelectric element cover 100 formed by insert molding, and the piezoelectric elements can be insulated and sealed from the ink, thereby improving the reliability.

Furthermore, a portion of each piezoelectric element 58 projects outwards from the position of the pressure chamber 52, in the upward direction in FIG. 11A, and this portion is the location where the wiring member 90 is to be formed subsequently.

As shown in FIG. 11B, each protective layer 112 covers the piezoelectric element 58 on the diaphragm 56, and is formed in such a manner that it avoids the molding holes 56*b*. The space occupied by the protective layer 112 subsequently becomes the cavity section 104 above the piezoelectric element 58. Each protective layer 112 is formed in such a manner that it also avoids the opening sections 56*a* (see FIG. 11A) provided on the diaphragm 56 at positions corresponding to the ink supply ports 53. As the protective layer 112, it is desirable to use a photosensitive resist.

Next, the diaphragm 56 where the peripheries of the piezoelectric elements 58 is covered with the protective layer 112 is enclosed and clamped with a metal mold, and resin is injected into the cavities formed in the mold, and the piezoelectric element cover 100 and the wiring members 90 are thus formed integrally onto the diaphragm 56 by insert molding.

Figure 12:
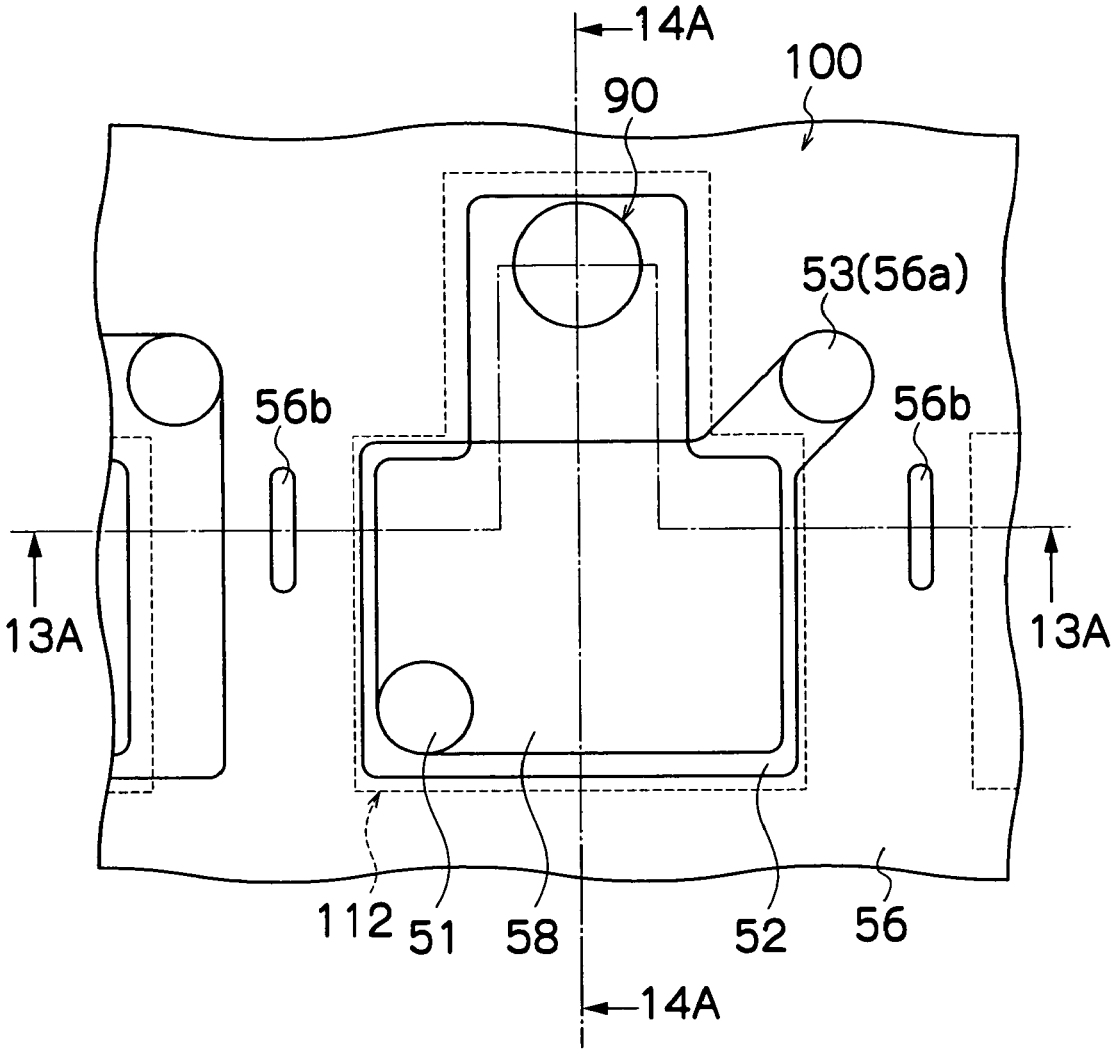
FIG. 12 is a plan view perspective diagram of the periphery of the piezoelectric element showing the piezoelectric element cover according to the second embodiment of the present invention.
Figure 13A:
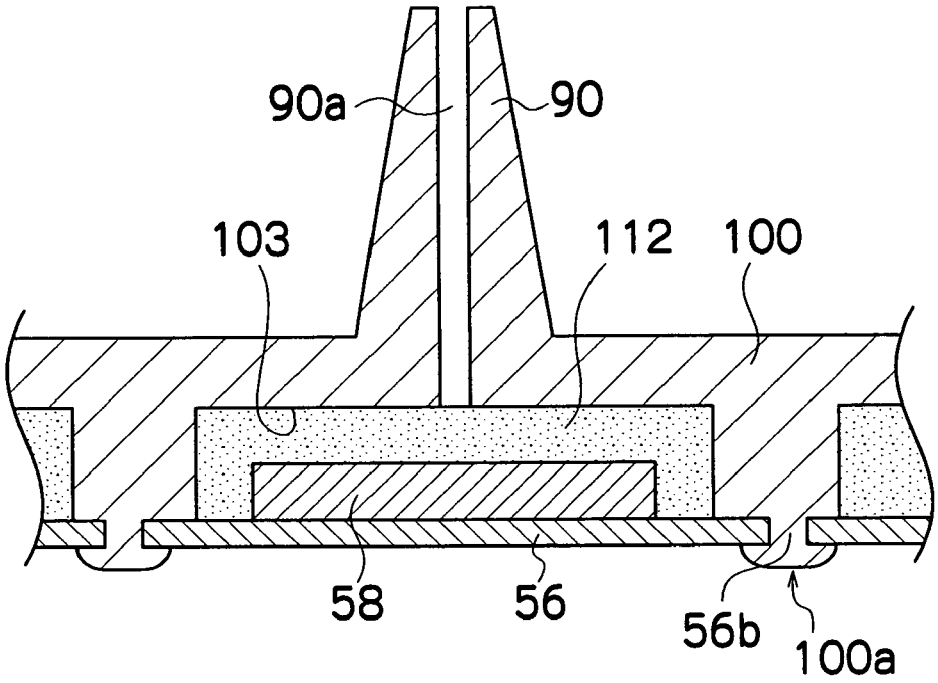
FIG. 13A is a cross-sectional diagram along line 13A-13A in FIG. 12 in a state where protective layers remain inside cavity sections.
Figure 13B:
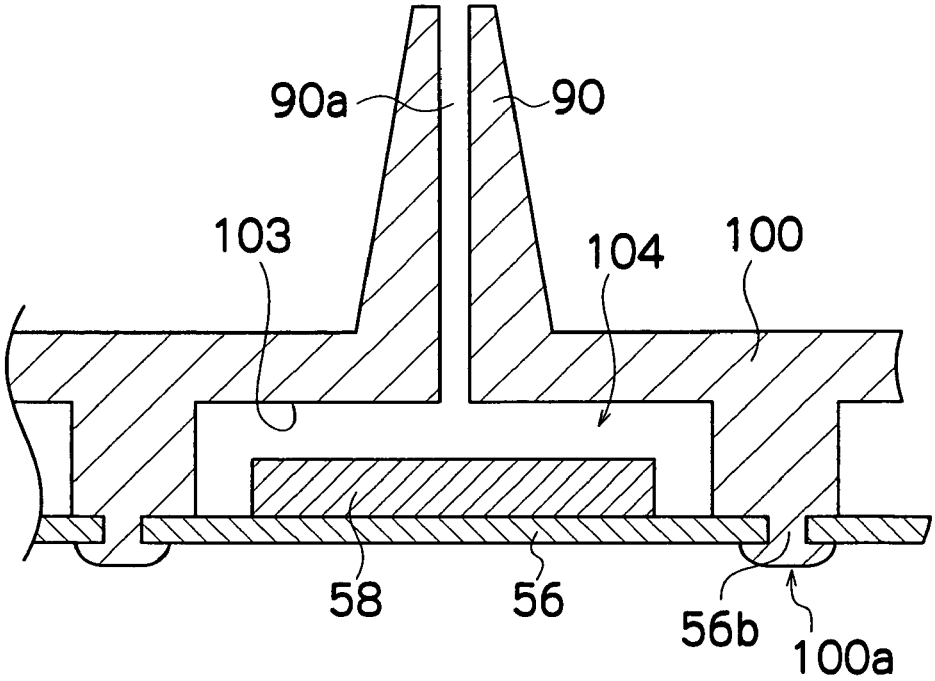
FIG. 13B is a cross-sectional diagram corresponding to FIG. 13A in a state where the protective layers inside the cavity sections have been removed.
Figure 14A:
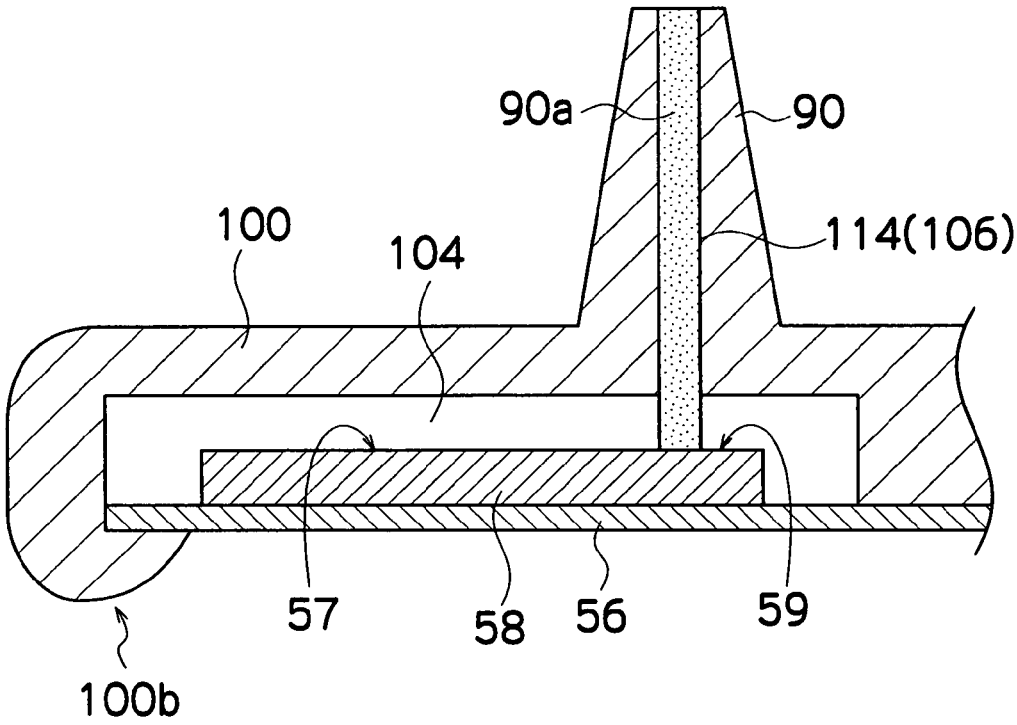
FIG. 14A is a cross-sectional diagram along line 14A-14A in FIG. 12 in a state where a conductive paste is introduced in ducts.
Figure 14B:
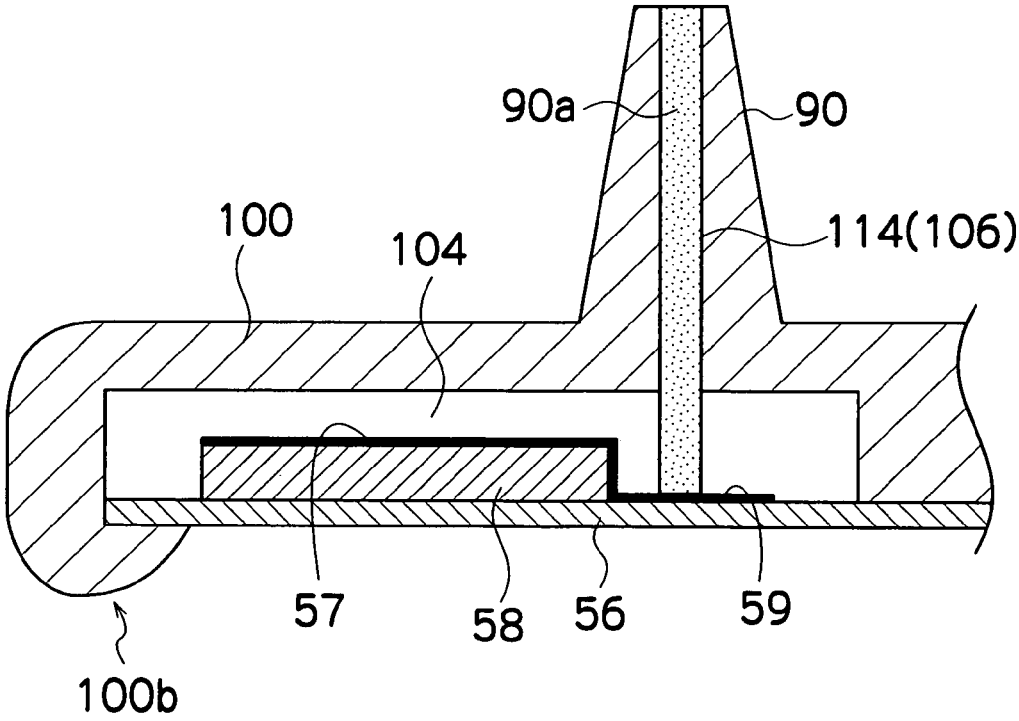
FIG. 14B is a cross-sectional diagram corresponding to FIG. 14A and shows an electrode pad according to another embodiment.

FIGS. 12 to 14B show steps of the insert molding with respect to the diaphragm 56 so that the piezoelectric element cover 100 and the wiring members 90 are integrally formed. FIG. 12 is a plan view perspective diagram of the periphery of the piezoelectric element 58; FIG. 13A is a cross-sectional diagram along line 13A-13A in FIG. 12 in a state where the protective layers 112 remain inside the recess sections 103; FIG. 13B is a cross-sectional diagram corresponding to FIG. 13A in a state where the protective layers 112 have been removed; FIG. 14A is a cross-sectional diagram along line 14A-14A in FIG. 12 in a state where a conductive paste 114 is introduced in ducts 90*a*; and FIG. 14B is a cross-sectional diagram corresponding to FIG. 14A and shows an electrode pad according to another embodiment.

As shown in FIG. 13A, the piezoelectric element cover 100 and the wiring members 90 are integrally formed by allowing resin to flow into the cavities in the mold (not shown). In this case, each wiring member 90 is formed in a tapered shape which narrows from the lower side to the upper side in FIG. 13A, and furthermore, the duct 90*a* for the electrical wire is formed inside each wiring member 90. Furthermore, each recess section 103 is formed with the protective layer 112 in the piezoelectric element cover 100. After the protective layer 112 is subsequently removed, the recess section 103 becomes the cavity section that ensures that the piezoelectric element 58 can be driven readily.

Furthermore, the resin entering into the cavities (not shown) leaks out to the rear side of the diaphragm 56 through the molding holes 56*b* in the diaphragm 56 and solidifies as indicated by reference numeral 100*a* in FIGS. 13A and 13B. Thereby, the piezoelectric element cover 100 and the diaphragm 56 are strongly bonded together, without peeling apart.

Next, as shown in FIG. 13B, after the resin has solidified, it is released from the mold and a liquid which dissolves the protective layer is introduced into the duct 90*a* provided in each wire member 90 and heated, thereby removing the protective layer 112 through the duct 90*a*. By removing the protective film 112, the cavity section 104 surrounded by the recess section 103 is formed around the piezoelectric element 58.

Next, as shown in FIG. 14A, the conductive paste 114, for example, is introduced into the ducts 90*a* of the wiring members 90, thereby forming the electrical wires 106. The lower portion of each electrical wire 106 is connected to the electrode pad 59 extending from the individual electrode 57 formed on the piezoelectric element 58. Furthermore, the upper portion of the electrical wire 106 is connected to the electrode of the multi-layered flexible cable, which is omitted from the drawing.

Moreover, in this case, since the electrical connection with the individual electrode 57 is achieved by means of the conductive paste 114 filled into the duct 90*a* in the wiring member 90. Therefore, if the wiring member 90 is disposed in the very center of the piezoelectric element 58 as in the first embodiment described above, it can obstruct driving of the piezoelectric element 58. Therefore, as shown in FIG. 14B, it is desirable that the electrode pad 59 is extended to the exterior of the piezoelectric element 58 completely and then connected to the conductive paste 114. In this way, by providing the junction between the electrode pad 59 and the conductive paste 114 at a position outside the piezoelectric element 58, there is no restriction of the movement of the piezoelectric element 58, and the piezoelectric element 58 can therefore be driven effectively.

Furthermore, in performing the insert molding, at the end sections of the diaphragm 56, the resin forming the piezoelectric element cover 100 travels round to the rear side of the diaphragm 56 through the end sections as indicated by a reference numeral 100*b* in FIGS. 14A and 14B. This resin, together with the resin sections 100*a*, which protrude from the rear side of the diaphragm 56 through the molding holes 56*b*, serves to strengthen the bonding between the piezoelectric element cover 100 and the diaphragm 56.

Next, a third embodiment of the present invention is described below. In the first and second embodiments described above, the piezoelectric element cover 100 is formed by a single plate over the whole surface of the print head 50 and has the individual cavity sections 104 (piezoelectric element covers in the narrow sense) corresponding to the piezoelectric elements 58. In the third embodiment, one cavity section is made so as to correspond to a plurality of the piezoelectric elements 58 aligned in one row, so that the plurality of the piezoelectric elements are covered with the one cavity section.

Figure 15:
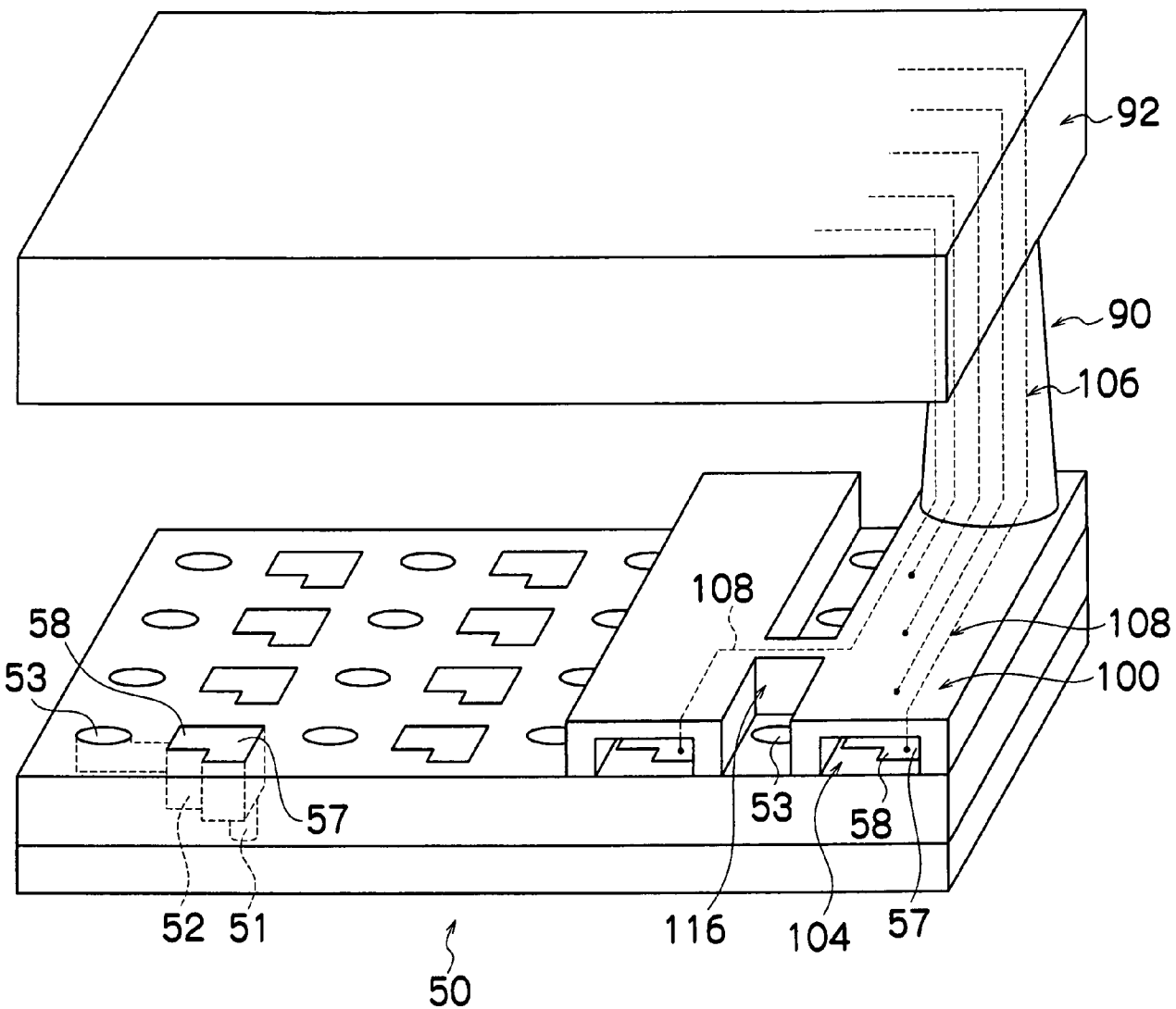
FIG. 15 is an oblique diagram showing the piezoelectric element cover according to a third embodiment of the present invention.

FIG. 15 shows an oblique view of the piezoelectric element cover according to the third embodiment.

As shown in FIG. 15, the piezoelectric element cover 100 according to the present embodiment has the cavity section 104 that covers two or more piezoelectric elements 58 arranged in the same one row, rather than having individual cavity sections to separately cover the piezoelectric elements 58. The term "row" here refers to a row in a direction along a straight line crossing the ink supply ports 53 and not crossing the pressure chambers 52. For example, in FIG. 15, the "row" extends in the width (short length) direction of the print head 50 (the vertical direction in FIG. 15). Even if a plurality of the piezoelectric elements 58 arranged in this direction are covered by one cavity 104 of the piezoelectric element cover 100 extending in this direction, the ink supply ports 53 are not contained inside the cavity section. The pressure chambers in the same row can be jointly covered.

In FIG. 15, in order to aid understanding, the piezoelectric element covers 100 are only disposed over the two rows on the right-hand side; however, in practice, the piezoelectric element covers 100 are also provided with respect to the piezoelectric elements 58 on the two rows on the left-hand side. By disposing the piezoelectric element cover 100 that covers a plurality of the piezoelectric elements 58 arranged in one row, without covering the ink supply ports 53, it is possible to reduce the bonding surface area between the diaphragm 56 and the piezoelectric element cover 100, and therefore, the reliability of the bond between the piezoelectric element cover 100 and the diaphragm 56 can be improved.

Furthermore, it is sufficient to arrange one wiring member 90 for one or a plurality of piezoelectric element covers 100 covering one or a plurality of rows of the piezoelectric elements 58. In this case, the electrodes are extended from the individual electrodes 57 of the piezoelectric elements 58 and connected to the electrical wires 108; the electrical wires 108 are arranged along the inner surface of the cavity sections 104 or inside the cavity sections 104; and the plurality of electrical wires 106 connected to the electrical wires 108 are made to pass through the one wiring member 90.

Furthermore, the piezoelectric element covers 100 covering the plurality of the piezoelectric elements 58 may be separately provided with respect to the rows. As shown in FIG. 15, each piezoelectric element cover 100 may be connected with the neighboring piezoelectric element cover 100 by means of a junction section 116. In this case, the junction sections 116 are disposed so as to avoid the positions of the ink supply ports 53. Furthermore, it is also possible to make the electrical wires 108 pass through the junction sections 116.

By connecting the piezoelectric element covers 100 corresponding to the plurality of rows with each other in this way, it is possible to reduce the number of the components and to reduce the manufacturing time even if the piezoelectric element covers 100 and the diaphragm 56 are bonded together as in the first embodiment, for example. In this case, there are no restrictions on the number of the junctions between the piezoelectric element covers 100 which are joined in this way.

Figure 16A:
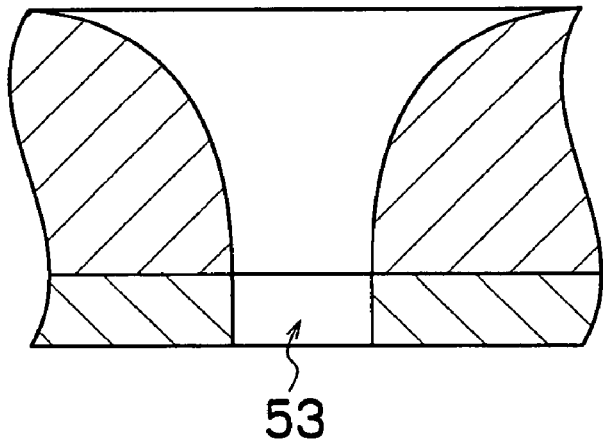
FIGS. 16A and 16B are cross-sectional diagrams showing the state of the vicinity of the ink supply port.
Figure 16B:
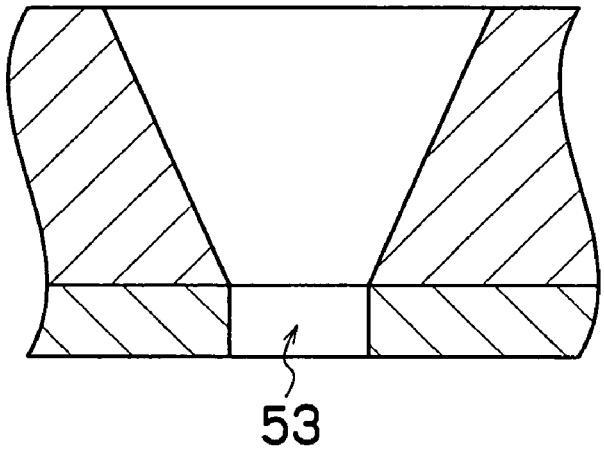

Furthermore, in the case that the piezoelectric element covers 100 corresponding to a plurality of rows are connected together, the junction sections 116 may be made from an elastic member (desirably, an elastic member including a polyimide film with 1 μm through 20 μm thick, and more desirably, an elastic member behind which a gaseous layer of air, or the like, is situated), and the elastic member may also serve as damper members for preventing the cross-talk and improving the refilling performance. Moreover, elastic members may be disposed in the junction sections 116. It is also possible to dispose a filter in the junction section 116 for preventing infiltration of foreign mater or air bubbles into the pressure chambers 52 (for example, a filter having pores of 0.5 μm to 20 μm diameter). Moreover, the shape of each junction section 116 and the shape of each piezoelectric element cover 100 are shown as being a rectangular shape in FIG. 15; however, there is no particular restriction on the shapes of the junction section 116 and the piezoelectric element cover 100. For example, each junction section 116 and/or each piezoelectric element cover 100 at the vicinity of the ink supply ports 53 are desirably formed in a curved shape (as shown in FIG. 16A, for example) or in a tapered shape (as shown in FIG. 16B, for example) in order to reduce the flow resistance.

Next, a fourth embodiment of the present invention is described below. The piezoelectric element cover according to the third embodiment described above has the cavity section that covers a plurality of the piezoelectric elements arranged in one row, whereas the piezoelectric element cover according to the fourth embodiment has a cavity section that covers a plurality of piezoelectric elements arranged in a two-dimensional matrix-form aligned in the longitudinal and lateral directions.

Figure 17:
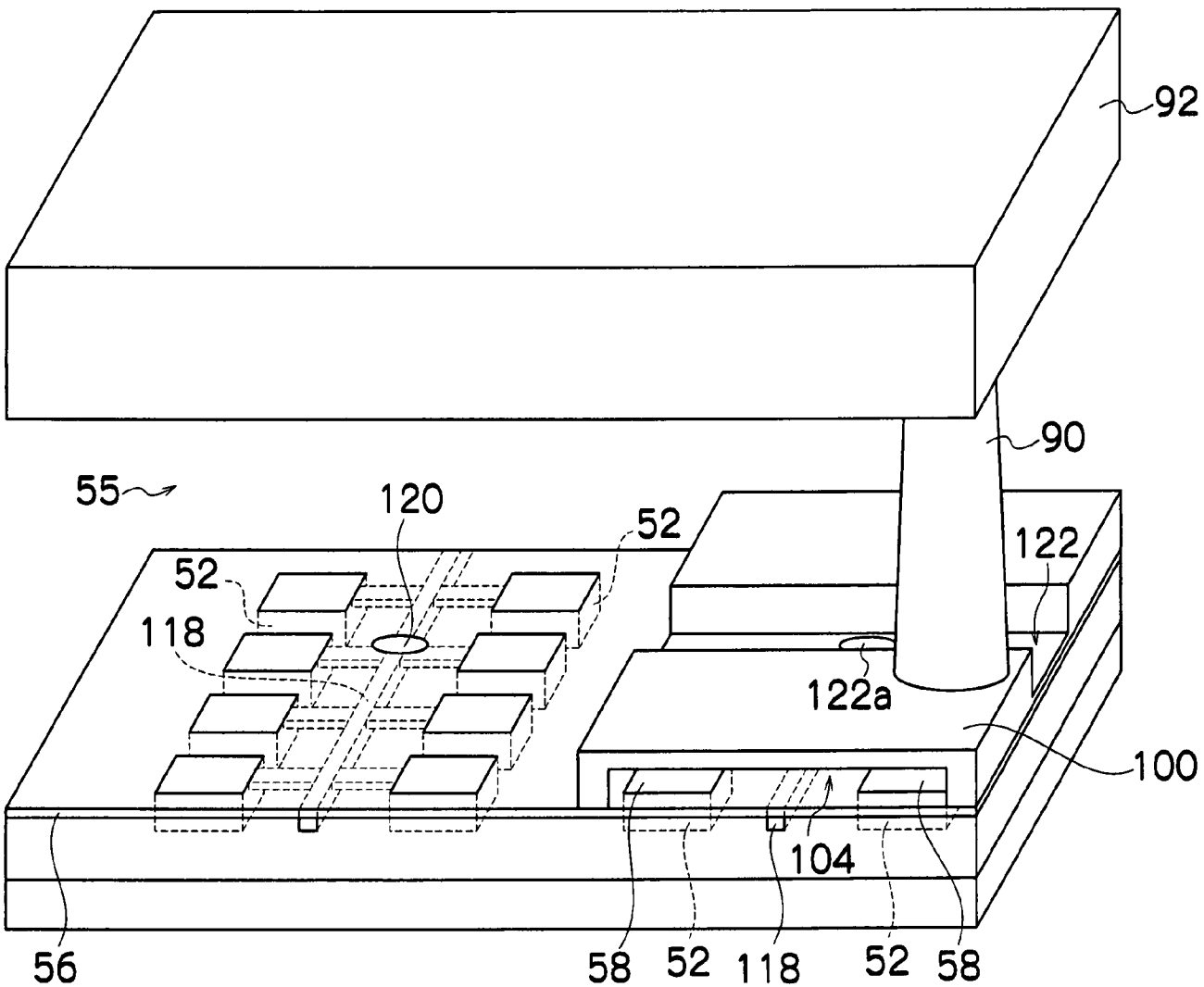
FIG. 17 is an oblique diagram showing piezoelectric element cover according to a fourth embodiment of the present invention.

FIG. 17 is an oblique diagram of the piezoelectric element cover according to the fourth embodiment. As shown in FIG. 17, each piezoelectric element cover 100 according to the present embodiment has the cavity section 104 that covers a plurality of the pressure elements 58 arranged in two rows. In FIG. 17, in view of aiding understanding, the piezoelectric element covers 100 are only depicted with respect to the two rows of the piezoelectric elements 58 on the right-hand side, and the piezoelectric element covers on the two rows on the left-hand side are omitted from the drawing in order that the ink supply system to the pressure chambers 52 can be shown. By covering two or more rows of the piezoelectric elements, it is possible to reduce the area of the bonding section in comparison with a case where only one row is covered. Hence, the reliability of the bond can be improved.

One wiring member 90 is formed on the piezoelectric element cover 100 integrally with the piezoelectric element cover 100, in respect of the plurality of piezoelectric elements 58 arranged in two rows that are covered with the one cavity section 104 of the piezoelectric element cover 100. The multi-layered flexible cable 92 is disposed on top of the wiring member 90, and the space between the multi-layered flexible cable 92 and the piezoelectric element cover 100 formed on the diaphragm 56 forms the common liquid chamber 55, which supplies ink to the pressure chambers 52.

As shown in FIG. 17, distributary channels (liquid supply channels) 118 for supplying ink are formed on the lower side of the diaphragm 56, in parallel with the rows of the pressure chambers 52 aligned in two rows. The ink is supplied from each distributary channel 118 to the pressure chambers 52 disposed on either side of each distributary channel 118. Furthermore, supply ports 120 are provided in the distributary channels 118 in order to supply ink to the distributary channels 118 from the common liquid chamber 55. These supply ports 120 are provided in positions on the corresponding distributary channels 118 at which no piezoelectric element 58 is located on either side.

The portion of each piezoelectric element cover 100 where the cavity section 104 is formed to cover a plurality of piezoelectric elements 58 aligned in two rows, has a protruding shape in the external appearance; however, the portion thereof where the supply port 120 corresponding to the distributary channel 118 is formed, has a recessed shape as indicated by reference numeral 122 in FIG. 17, in such a manner that the piezoelectric element cover 100 makes contact with the diaphragm 56. An opening section 122*a* connecting to the supply port 120 is formed in the recess portion 122. The number of supply ports 120 may be fewer than the number of the pressure chambers 52.

Figure 18:
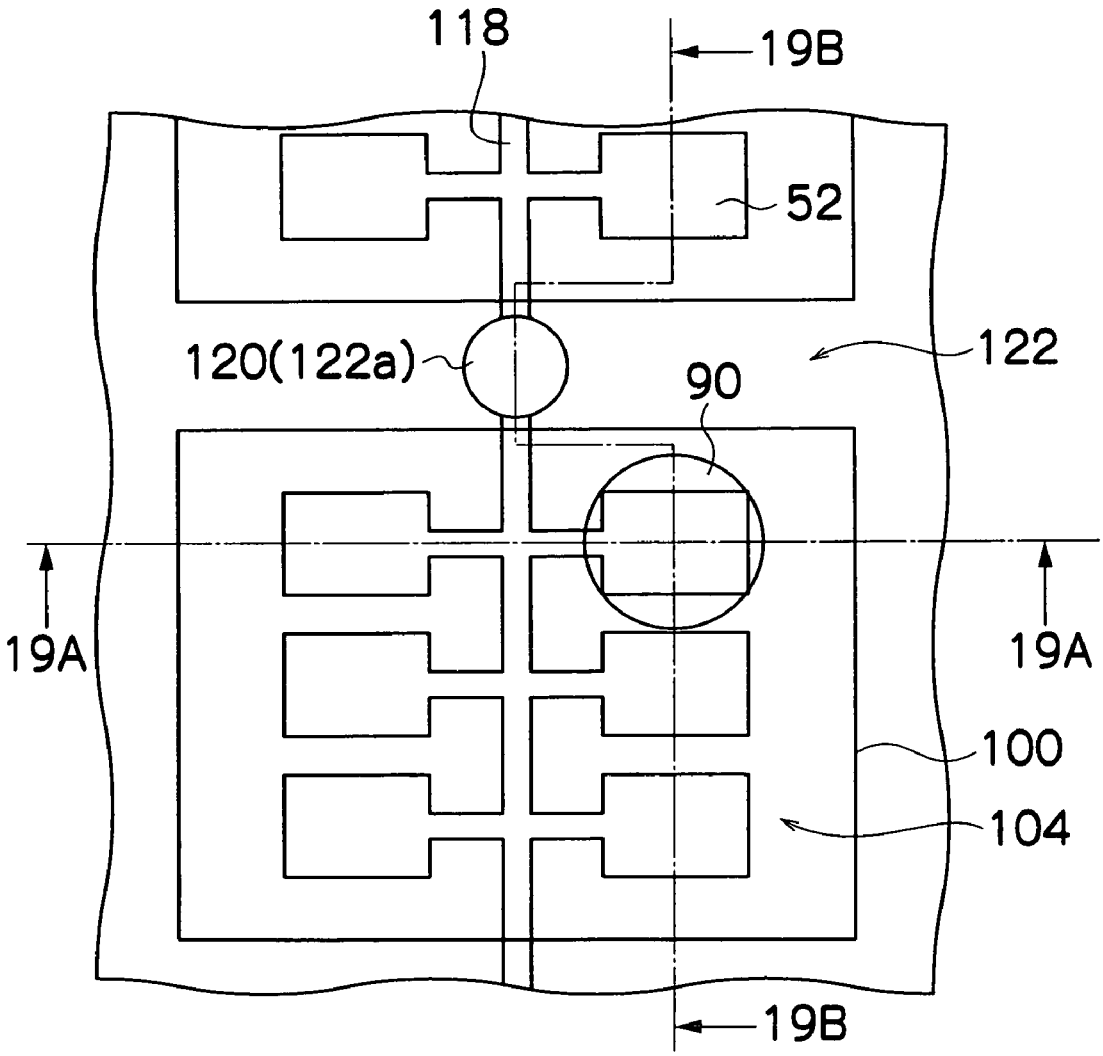
FIG. 18 is a plan view perspective diagram showing a portion of the piezoelectric element cover on the right-hand side of FIG. 17.
Figure 19A:
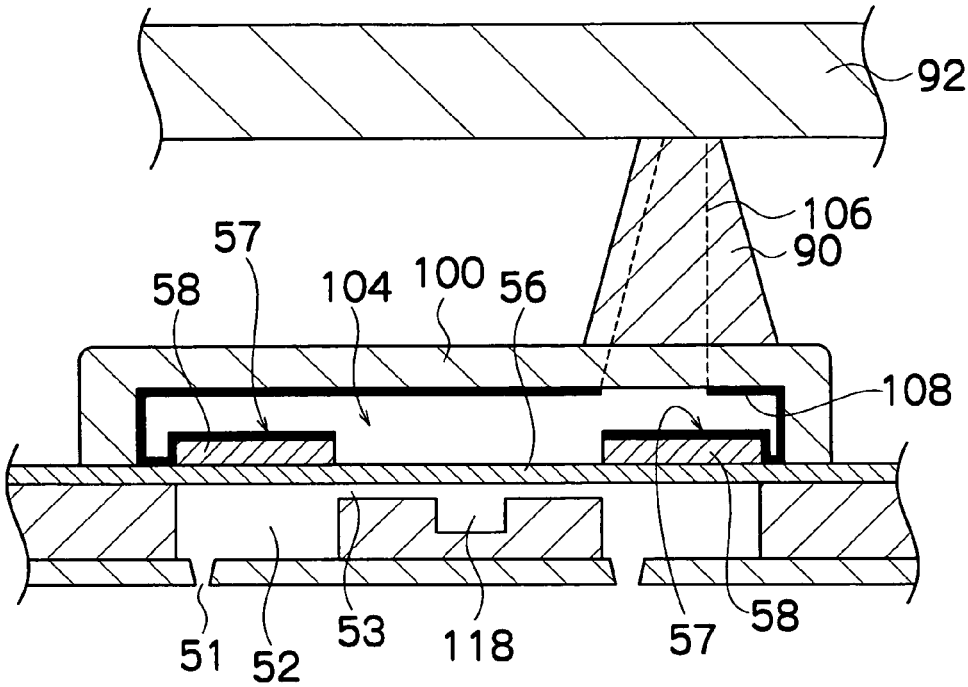
FIG. 19A is a cross-sectional diagram along line 19A-19A in FIG. 18.

FIG. 18 is a plan view perspective diagram showing the right-hand side of FIG. 17 where the piezoelectric element cover 100 is depicted. FIG. 19A shows a cross-sectional diagram along line 19A-19A in FIG. 18, and FIG. 19B shows a cross-sectional diagram along line 19B-19B in FIG. 18.

As shown in FIG. 19A, a plurality of the piezoelectric elements 58 arranged in two rows are disposed inside the cavity section 104 of each piezoelectric element cover 100. The wiring members 90 are formed on top of the cavity section 104 of each piezoelectric element cover 100. The electrical wires 108 are arranged along the inner surface of the cavity sections 104 (or inside same), from the individual electrodes 57 of the piezoelectric elements 58; are formed into the electrical wires 106 passing through the wiring members 90; and are connected to the multi-layered flexible cable 92 positioned above.

Furthermore, each distributary channel 118 for supplying ink is formed in parallel with the row direction of the pressure chambers 52 aligned in two rows, in such a manner that ink is supplied to the pressure chambers 52 through the ink supply ports 53.

Figure 19B:
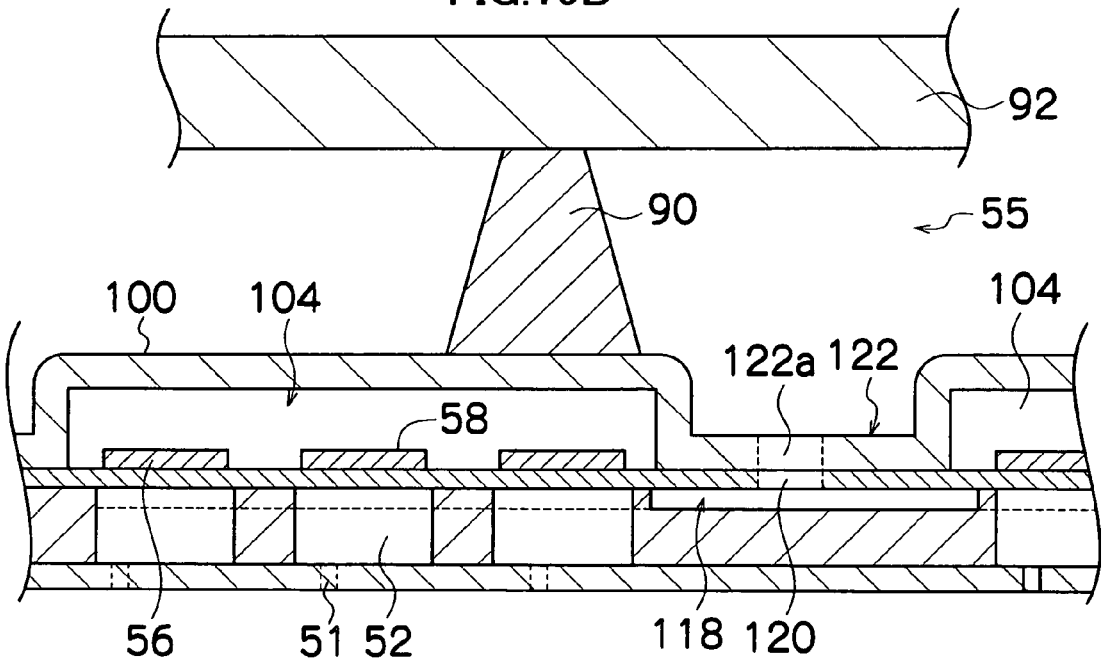
FIG. 19B is a cross-sectional diagram along line 19B-19B in FIG. 18.

In this case, as shown in FIG. 19B, the recess portion 122 is formed between the cavity sections 104, in the row direction of the pressure chambers 52 aligned in two rows, and each piezoelectric element cover 100 makes contact with the diaphragm 56 at the recess portion 122. The opening section 122*a* which connects to the supply port 120 for supplying ink to the distributary channel 118 from the common liquid chamber 55 is provided in the area of the recess portion 122.

It is not necessary to use only piezoelectric element covers 100 provided with cavity sections 104 that cover a plurality of piezoelectric elements 58 in the row direction according to the third embodiment, or only piezoelectric element covers 100 provided with cavity sections 104 that cover a plurality of piezoelectric elements 58 in the longitudinal and lateral directions according to the fourth embodiment. A combination of these piezoelectric element covers may be used.

Figure 20:
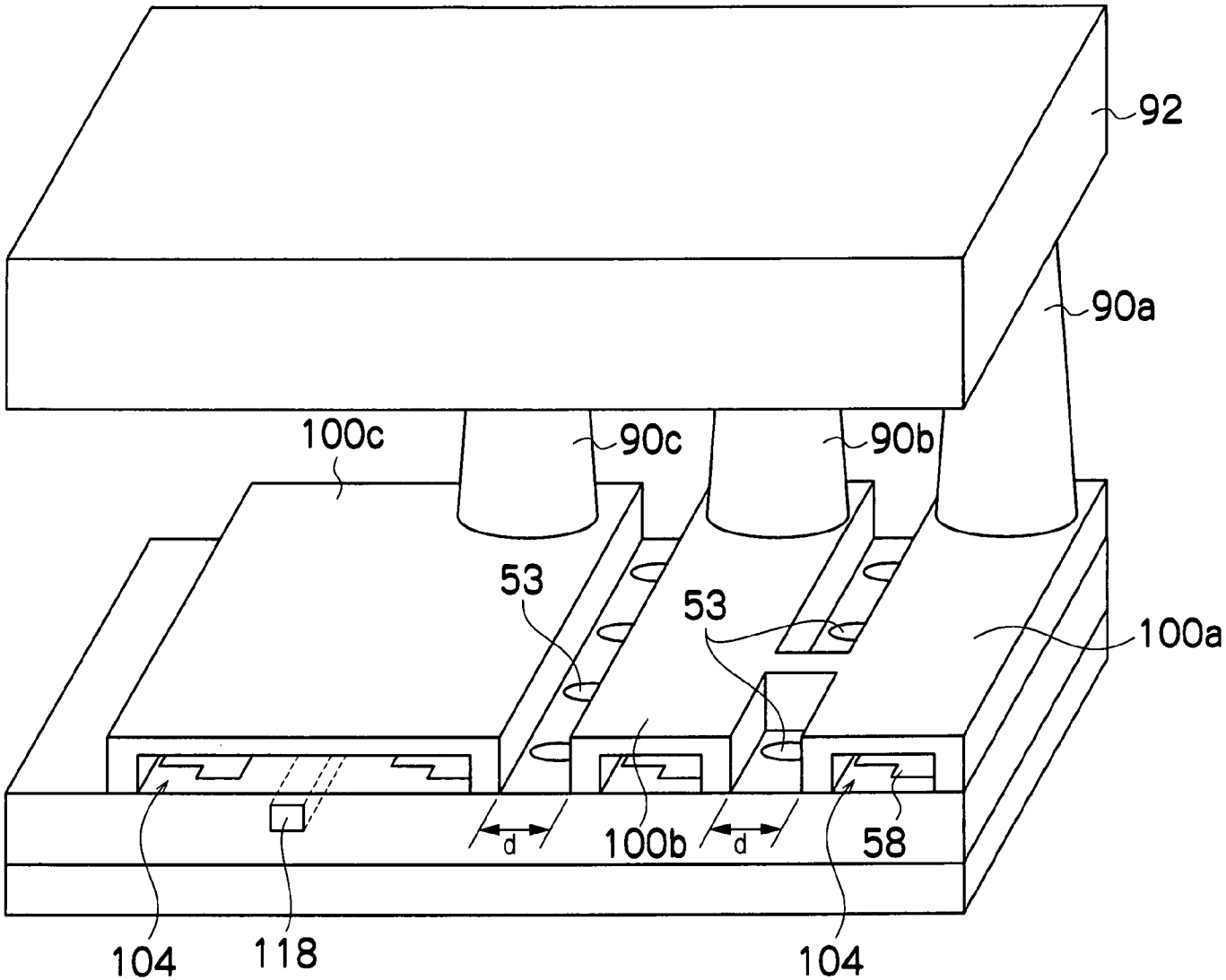
FIG. 20 is an oblique diagram of a modified example of the piezoelectric element cover according to the combination of the third embodiment and the fourth embodiment of the present invention.

For example, as shown in FIG. 20, it is also possible to provide both of the piezoelectric element covers 100*a* and 100*b* provided with cavity sections 104 each of which covers a plurality of piezoelectric elements 58 arranged in one row, and the piezoelectric element cover 100*c* provided with a cavity section 104 which covers a plurality of piezoelectric elements 58 arranged in two rows.

In the third embodiment or the fourth embodiment described above, if the piezoelectric element covers 100

(cavity sections 104) are arranged for each of the individual piezoelectric elements 58, then the width of each of the bonding-sections where the piezoelectric element covers 100 make contact with the diaphragm 56 is very narrow. For example, if the piezoelectric elements 58 are arranged at a pitch of 500 μm and the piezoelectric elements 58 each have a size of 300 μm, then the width d of each bonding-section shown in FIG. 20 is 100 μm or less, and the resistance to the flow of the ink toward the ink supply port 53 is therefore increased. Hence, taking account of the flow of ink, it is desirable to reduce the resistance by setting a larger value for the bonding width d in FIG. 20. In order to increase the bonding width d, desirably, the junction section between each piezoelectric element cover 100 and the diaphragm 56 is 50 μm or less. However, if each piezoelectric element cover 100 is bonded to the diaphragm 56 after the piezoelectric element cover 100 is integrally formed with the wiring members 90, then it is desirable for the bonding section to have a width of several hundred micrometers (μm), because it is difficult to obtain satisfactory bonding reliability in a case that the bonding section has a width of 50 μm in view of the variation in parts, the bonding variations, and the projection of bonding members such as adhesive.

Consequently, the piezoelectric elements 58 are arranged in a planar fashion in a two-dimensional matrix configuration so that the area of the bonding sections is desirably ensured by providing a gap with respect to each block which includes several piezoelectric elements 58, instead of arranging the piezoelectric elements 58 at regular intervals.

Furthermore, if the piezoelectric element cover 100 and the wiring members 90 are integrally formed, then the extrusion pins (EP) used to separate the piezoelectric element cover 100 and the wiring members 90 from the mold are desirably positioned at the prescribed intervals which allow the suitable separation from the mold; however, the extrusion pins for separating the wiring members 90 having high-aspect ratio are desirably positioned at an interval of 5 mm to 20 mm. In particular, a gap of approximately 1 mm is required at each of the locations where the extrusion pins are disposed, and therefore, the extrusion pins are desirably located in such a manner that the piezoelectric element cover 100 and the diaphragm 56 are bonded together in at least the regions of the extrusion pins.

Furthermore, as shown in FIG. 17, if each distributary channel 118 is provided in parallel with the pressure chambers 52 which are aligned in the row direction and ink is supplied to the pressure chambers 52 from the distributary channel 118, then the flow channel resistance is increased in comparison with a case where ink is supplied directly from the common liquid chamber 55 through the ink supply ports 53.

Figure 21A:
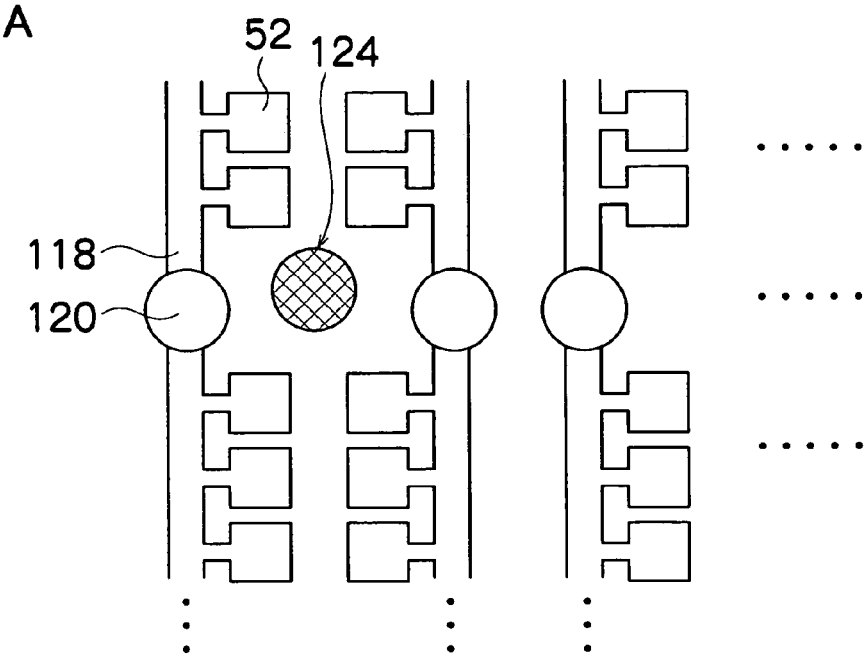
FIGS. 21A to 21C are plan diagrams showing examples of distributary channels for supplying ink to the pressure chambers.

In order to smooth the supply of the ink to the pressure chambers 52, desirably, a distributary channel 118 is provided for each row of pressure chambers 52, as shown in FIG. 21A, for example. Furthermore, in this case, the piezoelectric element covers 100 make contact with the diaphragm 56 in the regions where the supply ports 120 supplying ink to the distributary channels 118 are located, as shown in FIG. 17 or 19B, and the locations of the extractor pins 124 are desirably situated in these regions as described above.

Figure 21B:
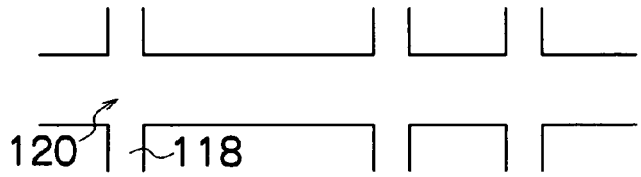

Furthermore, the supply ports 120 for supplying ink to the distributary channels 118 may be connected together as shown in FIG. 21B so as to improve the flow of ink, instead of being provided independently for each of the distributary channels 118.

Figure 21C:
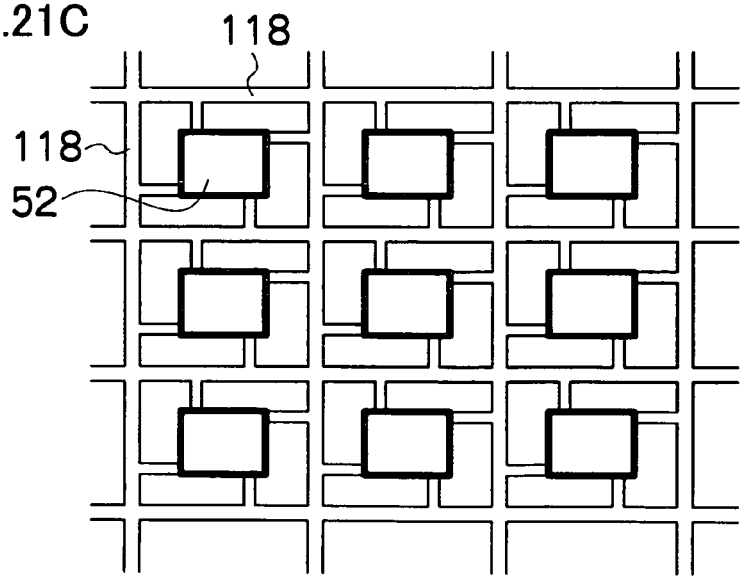

Moreover, it is also possible to supply ink to the pressure chambers 52 from four directions by positioning the distributary channels 118 in the longitudinal and the lateral directions as shown in FIG. 21C, instead of positioning the distributary channels 118 in one direction only.

Furthermore, in the third embodiment or the fourth embodiment described above, it is preferable to put a plurality of the electrical wires 106 together inside one wiring member 90, as shown in FIG. 15, for example. There are no particular limitations on such a structure of the wiring members 90 that contain a plurality of electrical wires 106, and various examples may be conceived as such a structure.

Figure 22A:
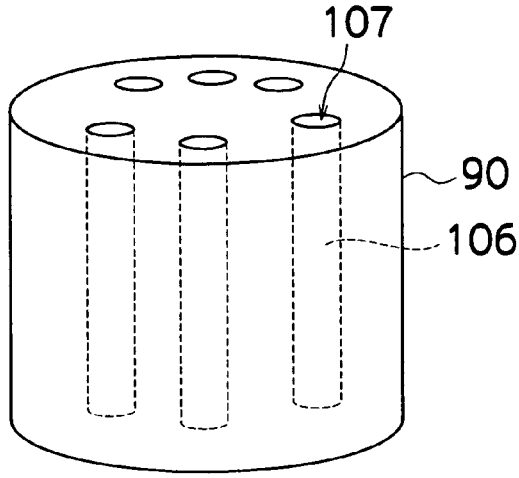
FIGS. 22A to 22C are oblique diagrams showing examples of the structure of a wiring member.

For example, as shown in FIG. 22A, the wiring member 90 provided with a plurality of ducts 107 for providing the required number of the electrical wires 106 may be fabricated by molding, whereupon electrical connections are formed by applying electric plating to the ducts 107 or introducing conductive paste into the ducts 107.

Figure 22B:
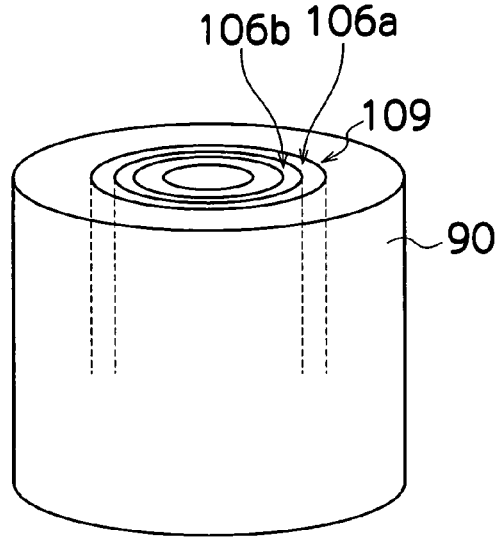

Furthermore, besides this, as shown in FIG. 22B, it is also possible to open a large duct 109 in the wiring member 90, and then to form a plurality of electrical wires 106 inside the wiring member 90 by forming conductive layers 106*a* and insulating layers 106*b* alternately repeatedly inside the duct by means of electroplating.

Figure 22C:
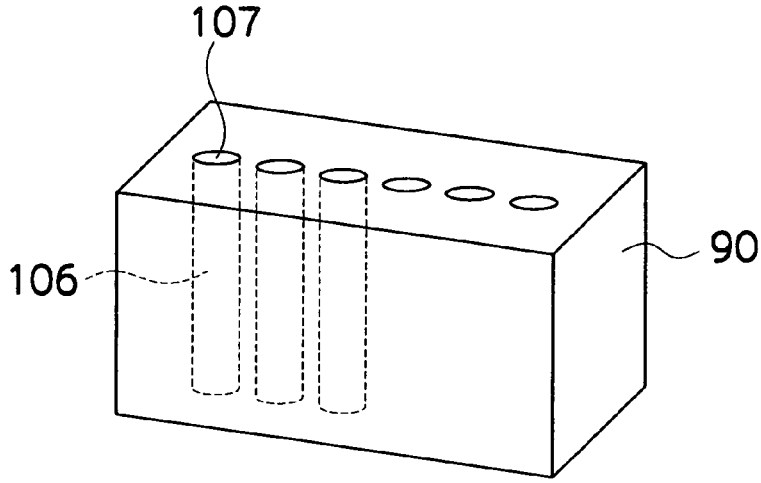

The shape of the wiring member 90 is not limited to a circular cylindrical shape (in practice, having a tapered part), and it is also possible to form the required number of the ducts 107 for the electrical wires 106 in a wall-shaped wiring member 90, as shown in FIG. 22C.

As described above, according to the embodiments of the present invention, the piezoelectric element cover and the wiring members are formed integrally by resin molding, and the electrical wires are disposed inside the wiring members. Accordingly, the density of the electrical wires can be increased, the reliability of the connections between the electrical wires in the piezoelectric element cover and the wiring members can be improved, and the insulating properties can be ensured more readily.

Although the liquid ejection head and the method of manufacturing the liquid ejection head according to the present invention are described in detail above, the present invention is not limited to the aforementioned embodiments. Furthermore, it is possible to make improvements or modifications of various kinds, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of pressure chambers which contain liquid and are arranged in a two-dimensional matrix configuration;

a plurality of nozzles which connect to the pressure chambers and eject the liquid;

a diaphragm which forms one face of the pressure chambers;

a plurality of piezoelectric elements which are formed on a face of the diaphragm reverse to a face thereof adjacent to the pressure chambers, each of the piezoelectric elements corresponding to each of the pressure chambers;

a plurality of electrical wires which connect to the piezoelectric elements and extend in a direction substantially perpendicular to the face on which the piezoelectric elements are formed;

a sealing member which seals off at least one of the piezoelectric elements and at least one of the electrical wires so that space is formed over a side of the at least one of the piezoelectric elements reverse to a side adjacent to the diaphragm; and a common liquid chamber which supplies the liquid to the pressure chambers and is arranged on a side of the sealing member reverse to a side thereof on which the pressure chambers are arranged.

2. The liquid ejection head as defined in claim 1, wherein the sealing member is formed by resin molding.

3. The liquid ejection head as defined in claim 1, wherein the sealing member is formed on the diaphragm by insert molding.

4. The liquid ejection head as defined in claim 1, wherein the sealing member collectively seals at least two of the piezoelectric elements.

5. The liquid ejection head as defined in claim 4, wherein the piezoelectric elements collectively sealed are arranged in one row direction.

6. The liquid ejection head as defined in claim 4, further comprising:

a liquid supply channel through which the liquid is supplied from the common liquid chamber to at least one of the pressure chambers, wherein the piezoelectric elements collectively sealed include at least two piezoelectric elements arranged in a longitudinal direction and at least two piezoelectric elements arranged in a lateral direction.

* * * * *